US009189926B2

(12) United States Patent
Hallerbach et al.

(10) Patent No.: US 9,189,926 B2
(45) Date of Patent: Nov. 17, 2015

(54) GAMING SYSTEM AND METHOD PROVIDING A SLOT GAME IN WHICH DIFFERENT SETS OF SYMBOLS ARE RANDOMLY ASSOCIATED WITH DIFFERENT SYMBOL DISPLAY AREAS AND USED TO DETERMINE AN OUTCOME

(71) Applicant: IGT, Las Vegas, NV (US)

(72) Inventors: Boris Hallerbach, Reno, NV (US); Gretchan P. Pooser, Reno, NV (US); Harvey Duenas, Reno, NV (US); Dave Ross, Reno, NV (US); Marc Meugniot, Sun Valley, NV (US); Dana Veltman, Reno, NV (US); Thomas Allen, II, Reno, NV (US); Kimberly A. Burgess, Sparks, NV (US); Lukas Blake, Sparks, NV (US); Ken Jacobs, Maryland Heights, MO (US); Erik Warren, Sparks, NV (US)

(73) Assignee: IGT, Las Vegas, NV (US)

( * ) Notice: Subject to any disclaimer, the term of this patent is extended or adjusted under 35 U.S.C. 154(b) by 92 days.

(21) Appl. No.: 14/021,638

(22) Filed: Sep. 9, 2013

(65) Prior Publication Data

US 2015/0072751 A1 Mar. 12, 2015

(51) Int. Cl.
*A63F 9/24* (2006.01)
*G07F 17/34* (2006.01)

(52) U.S. Cl.
CPC ..... *G07F 17/34* (2013.01)

(58) Field of Classification Search
CPC ... G07F 17/34; G07F 17/3213; G07F 17/326; A63F 2300/407; A63F 2300/572; A63F 2300/66
See application file for complete search history.

(56) References Cited

U.S. PATENT DOCUMENTS

| | | | | |
|---|---|---|---|---|
| 4,684,136 | A | | 8/1987 | Turner et al. |
| 5,372,366 | A | | 12/1994 | Gohlke et al. |
| 5,413,351 | A | | 5/1995 | Franklin et al. |
| 5,779,239 | A | | 7/1998 | Lind |
| 5,863,041 | A | | 1/1999 | Boylan et al. |
| 5,885,157 | A | | 3/1999 | Harada et al. |
| 6,117,009 | A | | 9/2000 | Yoseloff |
| 6,120,377 | A | | 9/2000 | McGinnis et al. |
| 6,123,333 | A | * | 9/2000 | McGinnis et al. ..... 273/146 |
| 6,173,955 | B1 | | 1/2001 | Perrie et al. |
| 6,213,876 | B1 | | 4/2001 | Moore, Jr. |
| 6,270,411 | B1 | | 8/2001 | Gura et al. |
| 6,286,834 | B1 | | 9/2001 | Caputo |
| 6,305,686 | B1 | | 10/2001 | Perrie et al. |
| 6,336,860 | B1 | | 1/2002 | Webb |
| 6,394,902 | B1 | | 5/2002 | Glavich et al. |

(Continued)

*Primary Examiner* — Steve Rowland
(74) *Attorney, Agent, or Firm* — Neal, Gerber & Eisenberg LLP

(57) ABSTRACT

Various embodiments of the present disclosure provide a gaming system and method providing a slot game in which, for each play of the slot game, different sets of symbols are randomly associated with different symbol display areas and used to determine an outcome for that play of the slot game. Generally, for each play of the slot game, the gaming system does so by: (a) randomly associating each of a plurality of different sets of symbols with a different one of a plurality of different symbol display areas; (b) for each of the sets of symbols, randomly selecting one of the symbols of that set to determine an outcome for that play of the slot game; and (c) displaying the randomly selected symbols at the associated symbol display areas (i.e., displaying the determined outcome).

20 Claims, 21 Drawing Sheets

(56) References Cited

U.S. PATENT DOCUMENTS

| | | | | |
|---|---|---|---|---|
| 6,413,161 | B1 | 7/2002 | Baerlocher et al. | |
| 6,413,162 | B1 | 7/2002 | Baerlocher et al. | |
| 6,474,647 | B1 | 11/2002 | Zakhar | |
| 6,561,900 | B1 | 5/2003 | Baerlocher et al. | |
| 6,565,088 | B2 | 5/2003 | Perrie et al. | |
| 6,616,142 | B2 | 9/2003 | Adams | |
| 6,634,945 | B2 | 10/2003 | Glavich et al. | |
| 6,656,047 | B1 | 12/2003 | Tarantino et al. | |
| 6,731,313 | B1 | 5/2004 | Kaminkow | |
| 6,746,016 | B2 | 6/2004 | Perrie et al. | |
| 6,776,711 | B1 | 8/2004 | Baerlocher | |
| 6,796,901 | B2 | 9/2004 | Baerlocher | |
| 6,802,774 | B1 | 10/2004 | Carlson et al. | |
| 6,887,157 | B2 | 5/2005 | LeMay et al. | |
| 6,913,262 | B2 | 7/2005 | Berman | |
| 6,913,532 | B2 | 7/2005 | Baerlocher et al. | |
| 6,932,340 | B1 | 8/2005 | Schaefer et al. | |
| 6,932,700 | B2 * | 8/2005 | Bennett et al. | 463/20 |
| 6,955,600 | B2 | 10/2005 | Glavich et al. | |
| 6,988,732 | B2 | 1/2006 | Vancura | |
| 6,997,803 | B2 | 2/2006 | LeMay et al. | |
| 7,004,836 | B2 | 2/2006 | Kaminkow et al. | |
| 7,014,560 | B2 | 3/2006 | Glavich et al. | |
| 7,048,275 | B2 | 5/2006 | Adams | |
| 7,056,213 | B2 | 6/2006 | Ching et al. | |
| 7,066,814 | B2 | 6/2006 | Glavich et al. | |
| 7,074,127 | B2 | 7/2006 | Cuddy et al. | |
| 7,081,050 | B2 | 7/2006 | Tarantino | |
| 7,090,580 | B2 | 8/2006 | Rodgers et al. | |
| 7,094,148 | B2 | 8/2006 | Baerlocher et al. | |
| 7,152,863 | B2 | 12/2006 | Scheb, Jr. et al. | |
| 7,172,505 | B2 | 2/2007 | Vancura | |
| 7,210,997 | B2 | 5/2007 | Hughs-Baird et al. | |
| 7,235,011 | B2 | 6/2007 | Randall et al. | |
| 7,252,591 | B2 | 8/2007 | Van Asdale | |
| 7,267,611 | B2 | 9/2007 | Slomiany et al. | |
| 7,367,885 | B2 | 5/2008 | Escalera et al. | |
| 7,371,170 | B2 | 5/2008 | Cregan et al. | |
| 7,381,134 | B2 | 6/2008 | Cuddy et al. | |
| 7,393,278 | B2 | 7/2008 | Gerson et al. | |
| 7,473,174 | B2 | 1/2009 | Cuddy et al. | |
| 7,556,267 | B2 | 7/2009 | Vancura et al. | |
| 7,578,735 | B2 | 8/2009 | Frizzell et al. | |
| 7,624,986 | B2 | 12/2009 | Nicely | |
| 7,666,083 | B2 | 2/2010 | Baerlocher et al. | |
| 7,682,246 | B2 | 3/2010 | Cregan et al. | |
| 8,142,274 | B2 | 3/2012 | Baerlocher | |
| 8,357,041 | B1 | 1/2013 | Saunders | |
| 8,366,538 | B1 | 2/2013 | Saunders et al. | |
| 8,430,737 | B2 | 4/2013 | Saunders | |
| 8,485,901 | B2 | 7/2013 | Saunders | |
| 2002/0036380 | A1 | 3/2002 | Perrie et al. | |
| 2002/0043766 | A1 | 4/2002 | Berman | |
| 2002/0084587 | A1 | 7/2002 | Bennett et al. | |
| 2002/0094857 | A1 * | 7/2002 | Meyer | 463/16 |
| 2002/0160827 | A1 | 10/2002 | Slomiany et al. | |
| 2002/0163127 | A1 | 11/2002 | Perrie et al. | |
| 2002/0193160 | A1 | 12/2002 | Tarantino | |
| 2003/0030216 | A1 | 2/2003 | Endoso | |
| 2003/0032479 | A1 | 2/2003 | LeMay et al. | |
| 2003/0071417 | A1 | 4/2003 | Webb | |
| 2003/0078103 | A1 | 4/2003 | LeMay et al. | |
| 2003/0094761 | A1 | 5/2003 | Furuta et al. | |
| 2003/0119574 | A1 | 6/2003 | Yang | |
| 2003/0144048 | A1 | 7/2003 | Silva | |
| 2003/0155708 | A1 | 8/2003 | Perrie et al. | |
| 2003/0176213 | A1 | 9/2003 | LeMay et al. | |
| 2003/0207707 | A1 | 11/2003 | Slomiany et al. | |
| 2003/0220137 | A1 | 11/2003 | Duhamel | |
| 2004/0002380 | A1 | 1/2004 | Brosnan et al. | |
| 2004/0033831 | A1 | 2/2004 | Tarantino | |
| 2004/0058727 | A1 * | 3/2004 | Marks et al. | 463/20 |
| 2004/0072614 | A1 | 4/2004 | Roukis | |
| 2004/0082373 | A1 | 4/2004 | Cole et al. | |
| 2004/0102245 | A1 | 5/2004 | Escalera et al. | |
| 2005/0003886 | A1 | 1/2005 | Englman et al. | |
| 2005/0014548 | A1 | 1/2005 | Thomas | |
| 2005/0049026 | A1 | 3/2005 | Angel | |
| 2005/0054418 | A1 | 3/2005 | Baerlocher | |
| 2005/0161879 | A1 | 7/2005 | Scheb et al. | |
| 2005/0164777 | A1 | 7/2005 | Daly | |
| 2005/0179201 | A1 | 8/2005 | DeSalvo | |
| 2009/0137309 | A1 * | 5/2009 | Thomas | 463/20 |
| 2009/0227337 | A1 | 9/2009 | Langille et al. | |
| 2011/0045906 | A1 | 2/2011 | Berman et al. | |
| 2012/0115606 | A1 | 5/2012 | Seelig | |
| 2012/0157180 | A1 | 6/2012 | Baerlocher | |
| 2013/0143645 | A1 | 6/2013 | Schaefer et al. | |
| 2013/0190066 | A1 | 7/2013 | Saunders | |

* cited by examiner

GAMING SYSTEM AND METHOD PROVIDING A SLOT GAME IN WHICH DIFFERENT SETS OF SYMBOLS ARE RANDOMLY ASSOCIATED WITH DIFFERENT SYMBOL DISPLAY AREAS AND USED TO DETERMINE AN OUTCOME

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming systems that provide players awards in primary or base games are well known. These gaming systems generally require a player to place a wager to activate a play of the primary game. For many of these gaming systems, any award provided to a player for a wagered-on play of a primary game is based on the player obtaining a winning symbol or a winning symbol combination and on an amount of the wager (e.g., the higher the amount of the wager, the higher the award). Winning symbols or winning symbol combinations that are less likely to occur typically result in larger awards being provided when they do occur.

For such known gaming systems, an amount of a wager placed on a primary game by a player may vary. For instance, a gaming system may enable a player to wager a minimum quantity of credits, such as one credit (e.g., in monetary currency, one penny, nickel, dime, quarter, or dollar; in non-monetary currency, one point, credit, coin, token, free play credit, or virtual buck), up to a maximum quantity of credits, such as five credits. The gaming system may enable the player to place this wager a single time or multiple times for a single play of the primary game. For instance, a gaming system configured to operate a slot game may have one or more paylines, and the gaming system may enable a player to place a wager on each of the paylines for a single play of the slot game. Thus, it is known that a gaming system, such as one configured to operate a slot game, may enable players to place wagers of substantially different amounts on each play of a primary game. For example, the amounts of the wagers may range from one credit up to 125 credits (e.g., five credits on each of twenty-five separate paylines). This is also true for other wagering games, such as video draw poker, in which players can place wagers of one or more credits on each hand, and in which multiple hands can be played simultaneously. Accordingly, it should be appreciated that different players play at substantially different wager amounts or levels and substantially different rates of play.

Bonus or secondary games are also known in gaming systems. Such gaming systems usually provide an award to a player for a play of one such bonus game in addition to any awards provided for any plays of any primary games. Bonus games usually do not require an additional wager to be placed by the player to be initiated. Bonus games are typically initiated or triggered upon an occurrence of a designated triggering symbol or designated triggering symbol combination in the primary game. For instance, a gaming system may initiate or trigger a bonus game when a bonus symbol occurs on the payline on the third reel of a three reel slot machine. The gaming systems generally indicates when a bonus game is initiated or triggered through one or more visual and/or audio output devices, such as the reels, lights, speakers, display screens, etc. Part of the enjoyment and excitement of playing certain gaming systems is the initiation or triggering of a bonus game, even before the player knows an amount of a bonus award won via the bonus game.

Various players continually seek out new and different variations to gaming systems. A continuing need thus exists for gaming systems and methods that provide new, exciting, and engaging games.

SUMMARY

Various embodiments of the present disclosure provide a gaming system and method providing a slot game in which, for each play of the slot game, different sets of symbols are randomly associated with different symbol display areas and used to determine an outcome for that play of the slot game. Generally, for each play of the slot game, the gaming system does so by: (a) randomly associating each of a plurality of different sets of symbols with a different one of a plurality of different symbol display areas; (b) for each of the sets of symbols, randomly selecting one of the symbols of that set to determine an outcome for that play of the slot game; and (c) displaying the randomly selected symbols at the associated symbol display areas (i.e., displaying the determined outcome).

More specifically, for a play of a slot game in one embodiment, the gaming system displays a plurality of symbol display areas. For each of the symbol display areas, the gaming system randomly associates one of a plurality of different sets or groups of two or more symbols with that symbol display area. For each of the symbol display areas, the gaming system randomly determines one of the symbols of the set of symbols associated with that symbol display area. For each of the symbol display areas, the gaming system displays the randomly determined symbol of the set of symbols associated with that symbol display area at that symbol display area. The gaming system determines any awards associated with the displayed symbols and displays any determined awards.

Upon an occurrence of a bonus triggering event, the gaming system provides a bonus. For a play of the bonus in this embodiment, the gaming system provides a designated quantity of free plays of the slot game. In this embodiment, the gaming system evaluates the symbols displayed following the first free play and determines how many displayed symbols (if any) match one another. The gaming system designates the symbol having the most matches as a locking symbol for the duration of the bonus. If two symbols have the same quantity of matches, the gaming system designates the higher value symbol as the locking symbol in this embodiment. Whenever a locking symbol is displayed following a free play (including following the first free play), the gaming system locks or holds that locking symbol at the symbol display area at which that locking symbol is displayed for the remaining free plays.

It should thus be appreciated that the gaming system and method of the present disclosure provide a new slot game to increase player enjoyment, entertainment, and excitement.

Additional features and advantages are described herein, and will be apparent from, the following Detailed Description and the Figures.

DETAILED DESCRIPTION

Slot Game in which Different Sets of Symbols are Randomly Associated with Different Symbol Display Areas and Used to Determine an Outcome Various embodiments of the present disclosure provide a gaming system and method providing a slot game in which, for each play of the slot game, different sets of symbols are randomly associated with different symbol display areas and used to determine an outcome for that play of the slot game. Generally, for each play of the slot game, the gaming system does so by: (a) randomly associating each of a plurality of different sets of symbols with a different one of a plurality of different symbol display areas; (b) for each of the sets of symbols, randomly selecting one of the symbols of that set to determine an outcome for that play of the slot game; and (c) displaying the randomly selected symbols at the associated symbol display areas (i.e., displaying the determined outcome). While any credit balances, any wagers, and any awards are displayed as amounts of monetary currency or credits in the embodiments described below, one or more of such credit balances, such wagers, and such awards may be for any suitable non-monetary credits or currency, promotional credits, and/or player tracking points or credits.

Figure 1:
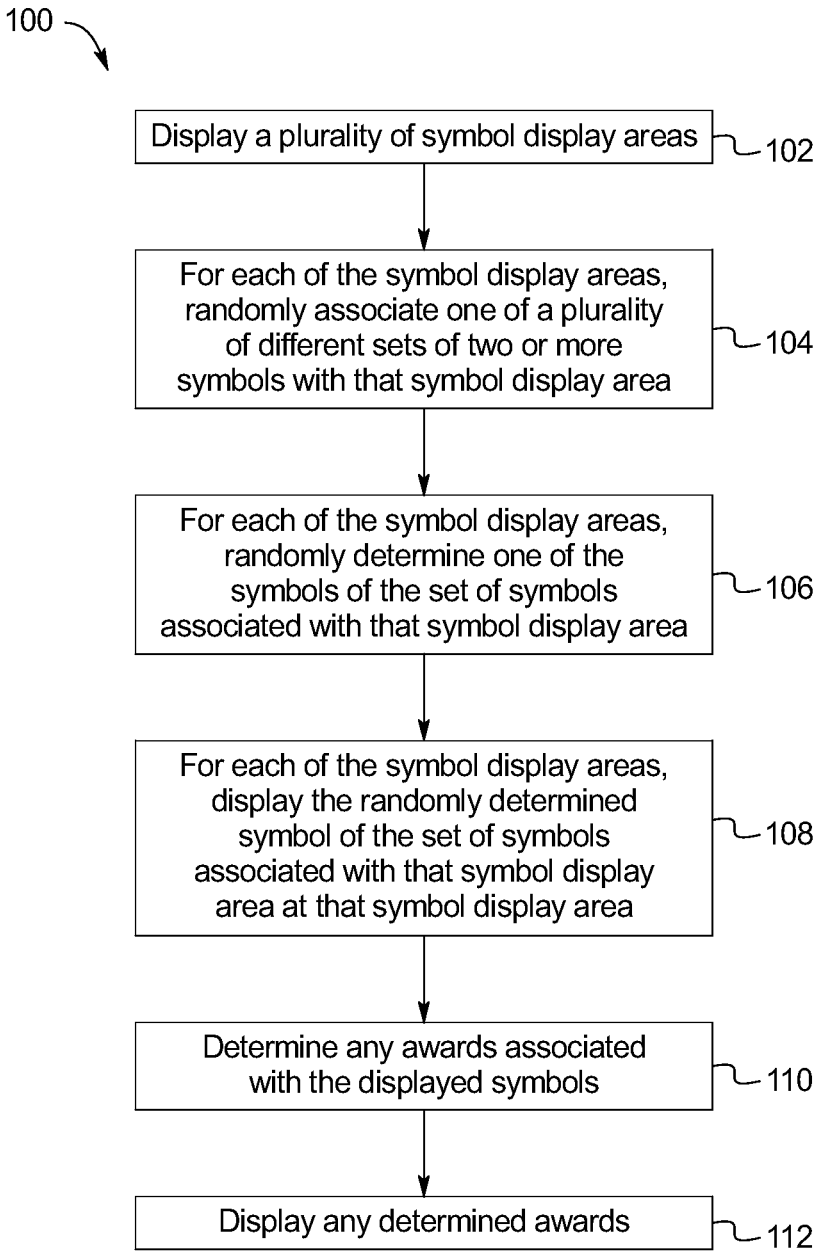
FIG. 1 is a flowchart illustrating an example method of operating one embodiment of the gaming system of the present disclosure.

FIG. 1 illustrates a flowchart of an example process or method 100 of operating one embodiment of the gaming system of the present disclosure. In various embodiments, the process 100 is represented by a set of instructions stored in one or more memories and executed by one or more processors. Although the process 100 is described with reference to the flowchart shown in FIG. 1, it should be appreciated that many other processes of performing the acts associated with this illustrated process 100 may be employed. For example, the order of certain of the illustrated blocks may be changed, certain of the illustrated blocks may be optional, and/or certain of the illustrated blocks may not be employed.

In operation of this example embodiment, for a play of a slot game, the gaming system displays a plurality of symbol display areas, as indicated by block 102. For each of the symbol display areas, the gaming system randomly associates one of a plurality of different sets or groups of two or more symbols with that symbol display area, as indicated by block 104. For each of the symbol display areas, the gaming system randomly determines one of the symbols of the set of symbols associated with that symbol display area, as indicated by block 106. For each of the symbol display areas, the gaming system displays the randomly determined symbol of the set of symbols associated with that symbol display area at that symbol display area, as indicated by block 108. The gaming system determines any awards associated with the displayed symbols, as indicated by block 110, and displays any determined awards, as indicated by block 112.

FIGS. 2A, 2B, 2C, and 2D illustrate one example embodiment of the slot game of the present disclosure implemented as a primary wagering game. As described in detail below, in this example embodiment, the slot game is associated with nine different sets of symbols (or symbol sets) each of which is associated with six symbols. Each of the symbol sets is represented by a six-sided object (such as a cube, a die, or any other suitable object). For each of the objects, each of the sides of that object displays one of the six symbols of the symbol set represented by that object. For a play of the slot game in this example embodiment: (a) the gaming system randomly associates each of the objects (and, therefore, each of the symbol sets) with a different one of nine object display areas; and (b) for each of the objects, the gaming system randomly selects one of the symbols on that object (and, therefore, one of the symbols of the symbol set represented by that object) and displays that object at the associated object display area with the side of the object displaying that randomly selected symbol facing upward (i.e., displays the randomly determined symbol of the symbol set represented by that object). The gaming system determines whether the upwardly-facing symbols form any winning symbol combinations, and displays any awards associated with any displayed winning symbol combinations. The gaming system provides a bonus upon an occurrence of a bonus triggering event, which in this example embodiment occurs when an outcome of a play of the slot game includes a designated quantity of three (or any suitable quantity) Bonus symbols displayed facing upward in a scatter configuration.

Figure 2A:
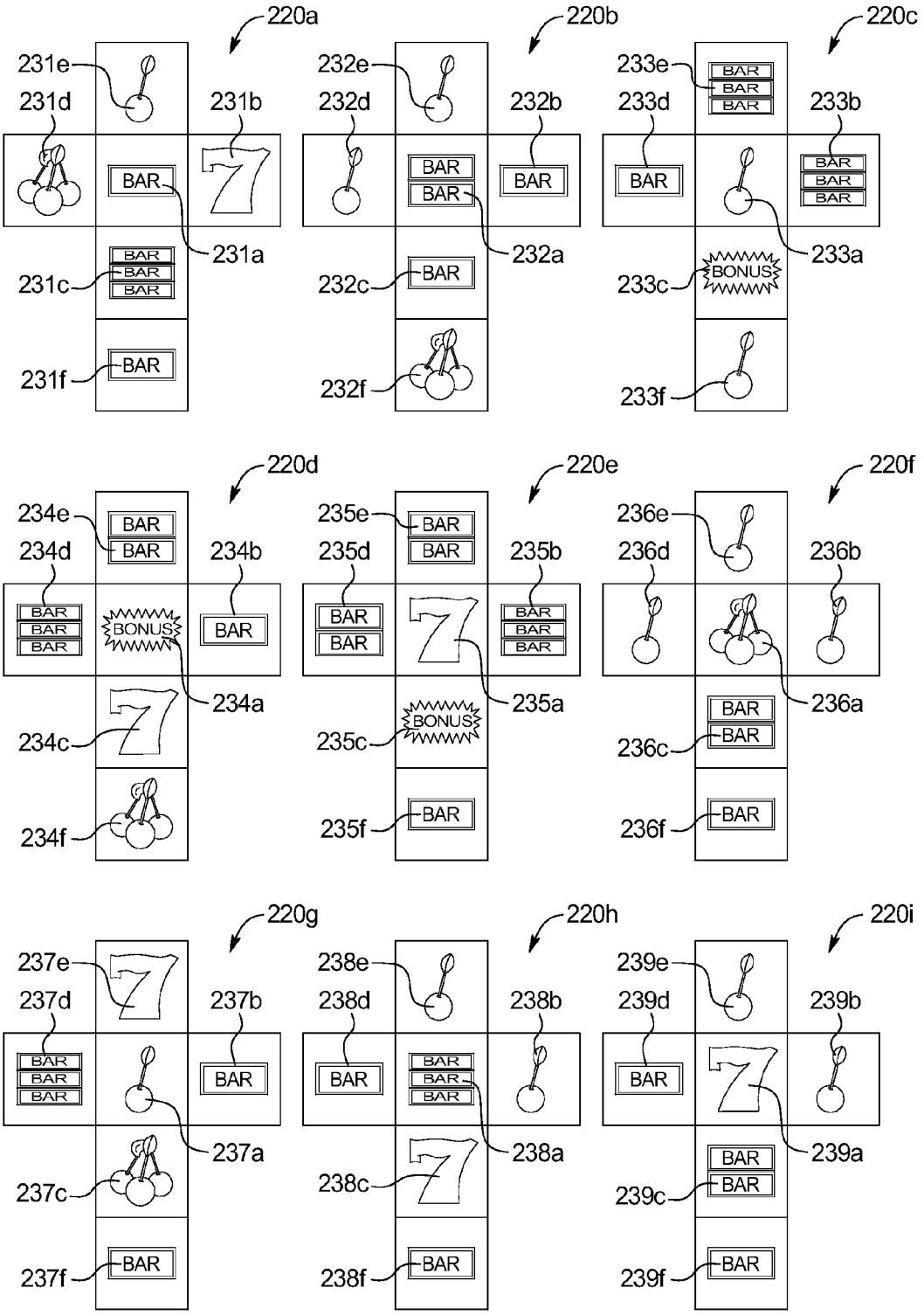
FIGS. 2A, 2B, 2C, and 2D illustrate one example embodiment of the slot game of the present disclosure implemented as a primary wagering game.

As noted above, each of the objects represents and displays the symbols included in one of the symbol sets associated with the slot game. Turning to FIG. 2A, FIG. 2A illustrates each of the nine objects 220*a*, 220*b*, 220*c*, 220*d*, 220*e*, 220*f*, 220*g*, 220*h*, and 220*i* in a "flattened" state such that each of the six symbols associated with each of the objects (and, therefore, each of the symbols of each of the nine symbol sets) is shown. More specifically, in this example embodiment: (a) the object 220*a* (and the symbol set associated with the object 220*a*) includes Bar symbol 231*a*, Seven symbol 231*b*, Triple Bar symbol 231*c*, Triple Cherry symbol 231*d*, Cherry symbol 231*e*, and Bar symbol 231*f*; (b) the object 220*b* (and the symbol set associated with the object 220*b*) includes Double Bar symbol 232*a*, Bar symbol 232*b*, Bar symbol 232*c*, Cherry symbol 232*d*, Cherry symbol 232*e*, and Triple Cherry symbol 232*f*; (c) the object 220*c* (and the symbol set associated with the object 220*c*) includes Cherry symbol 233*a*, Triple Bar symbol 233*b*, Bonus symbol 233*c*, Bar symbol 233*d*, Triple Bar symbol 233*e*, and Cherry symbol 233*f*; (d) the object 220*d* (and the symbol set associated with the object 220*d*) includes Bonus symbol 234*a*, Bar symbol 234*b*, Seven symbol 234*c*, Triple Bar symbol 234*d*, Double Bar symbol 234*e*, and Triple Cherry symbol 234*f*; (e) the object 220*e* (and the symbol set associated with the object 220*e*) includes Seven symbol 235*a*, Triple Bar symbol 235*b*, Bonus symbol 235*c*, Double Bar symbol 235*d*, Double Bar symbol 235*e*, and Bar symbol 235*f*; (f) the object 220*f* (and the symbol set associated with the object 220*f*) includes Triple Cherry symbol 236*a*, Cherry symbol 236*b*, Double Bar symbol 236*c*, Cherry symbol 236*d*, Cherry symbol 236*e*, and Bar symbol 236*f*; (g) the object 220*g* (and the symbol set associated with the object 220*g*) includes Cherry symbol 237*a*, Bar symbol 237*b*, Triple Cherry symbol 237*c*, Triple Bar symbol 237*d*, Seven symbol 237*e*, and Bar symbol 237*f*; (h) the object 220*h* (and the symbol set associated with the object 220*h*) includes Triple Bar symbol 238*a*, Cherry symbol 238*b*, Seven symbol 238*c*, Bar symbol 238*d*, Cherry symbol 238*e*, and Bar symbol 238*f*; and (i) the object 220*i* (and the symbol set associated with the object 220*i*) includes Seven symbol 239*a*, Cherry symbol 239*b*, Double Bar symbol 239*c*, Bar symbol 239*d*, Cherry symbol 239*e*, and Bar symbol 239*f*.

Figure 2B:
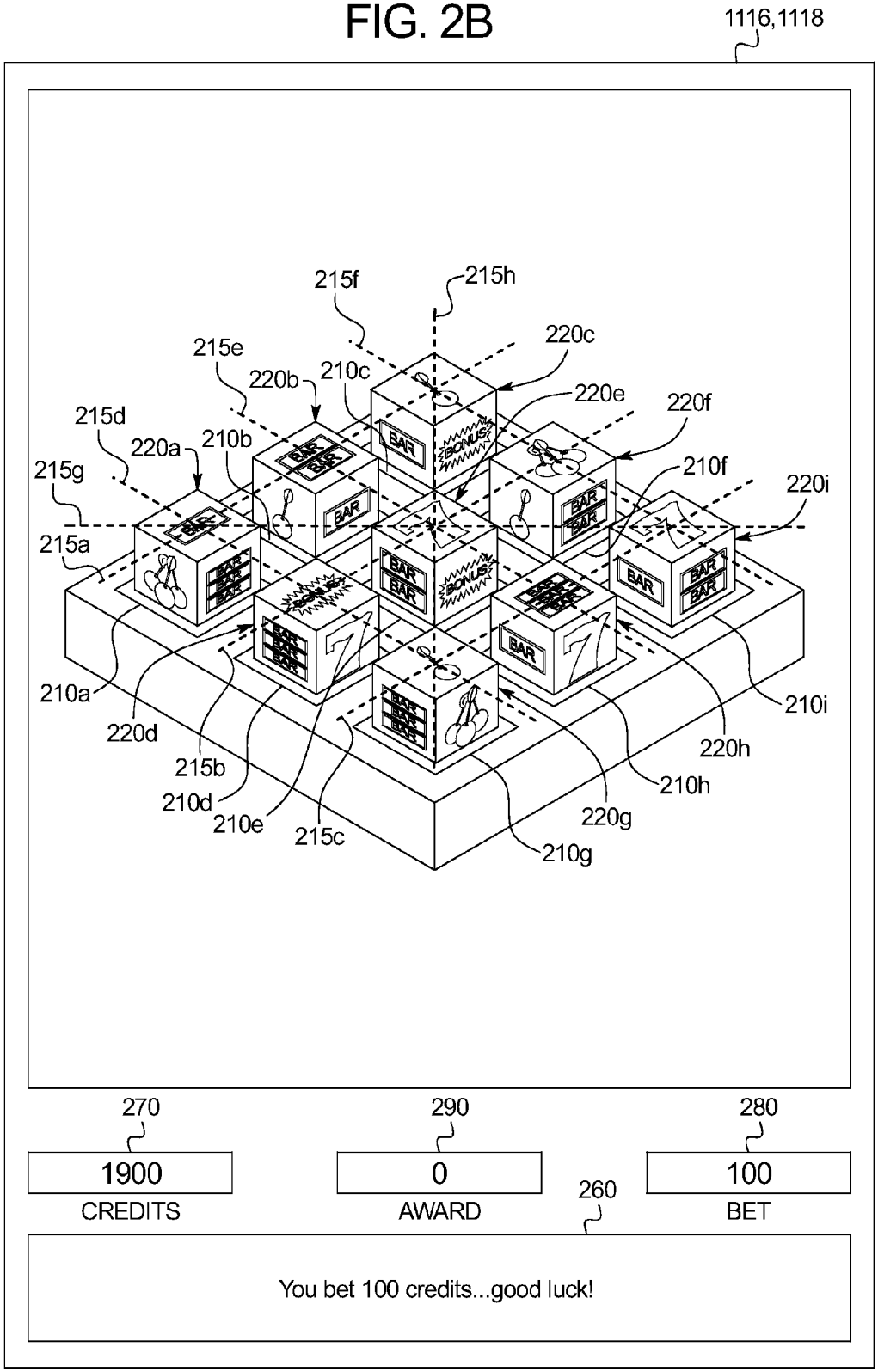
Figure 2C:
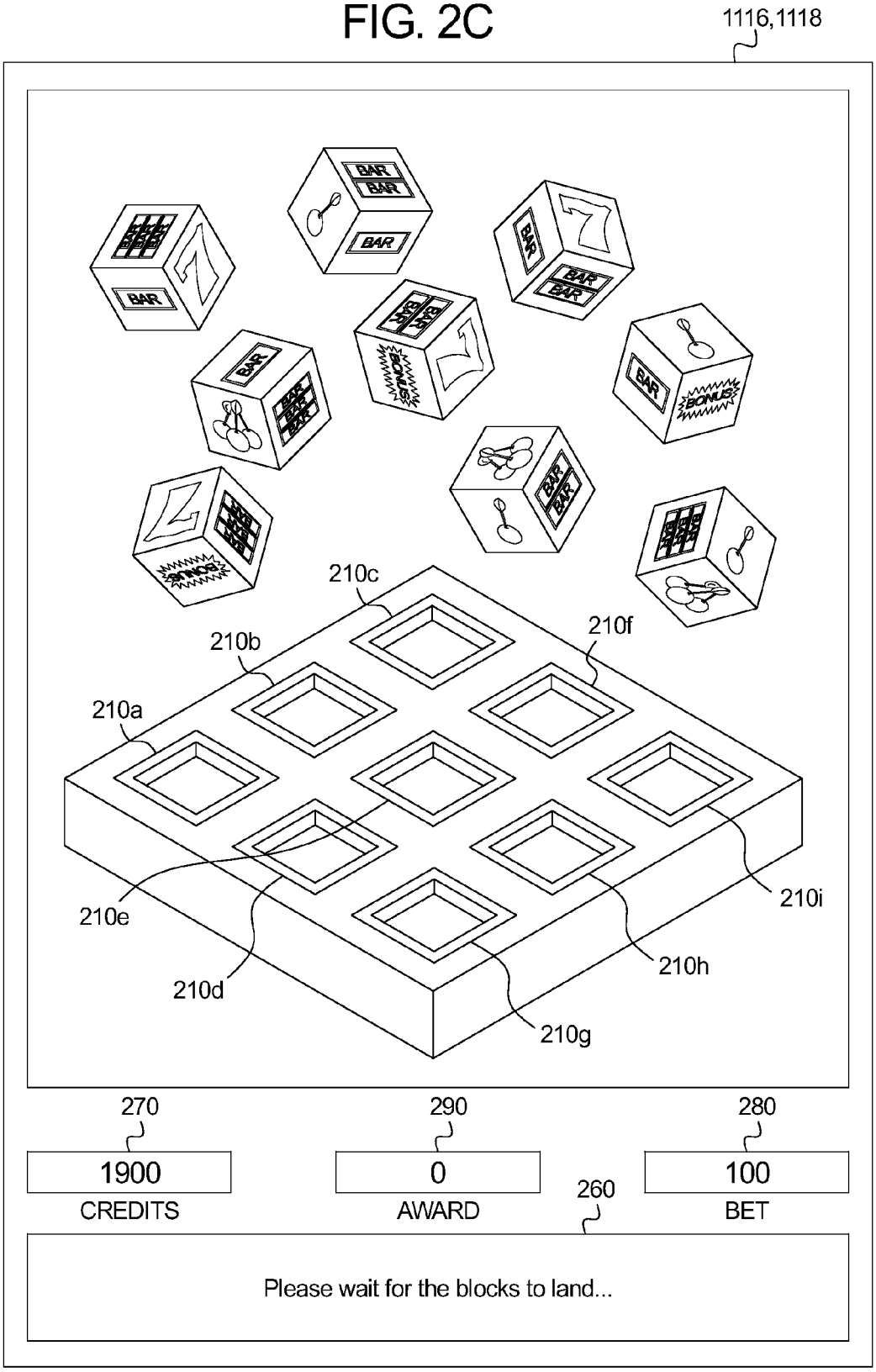
Figure 2D:
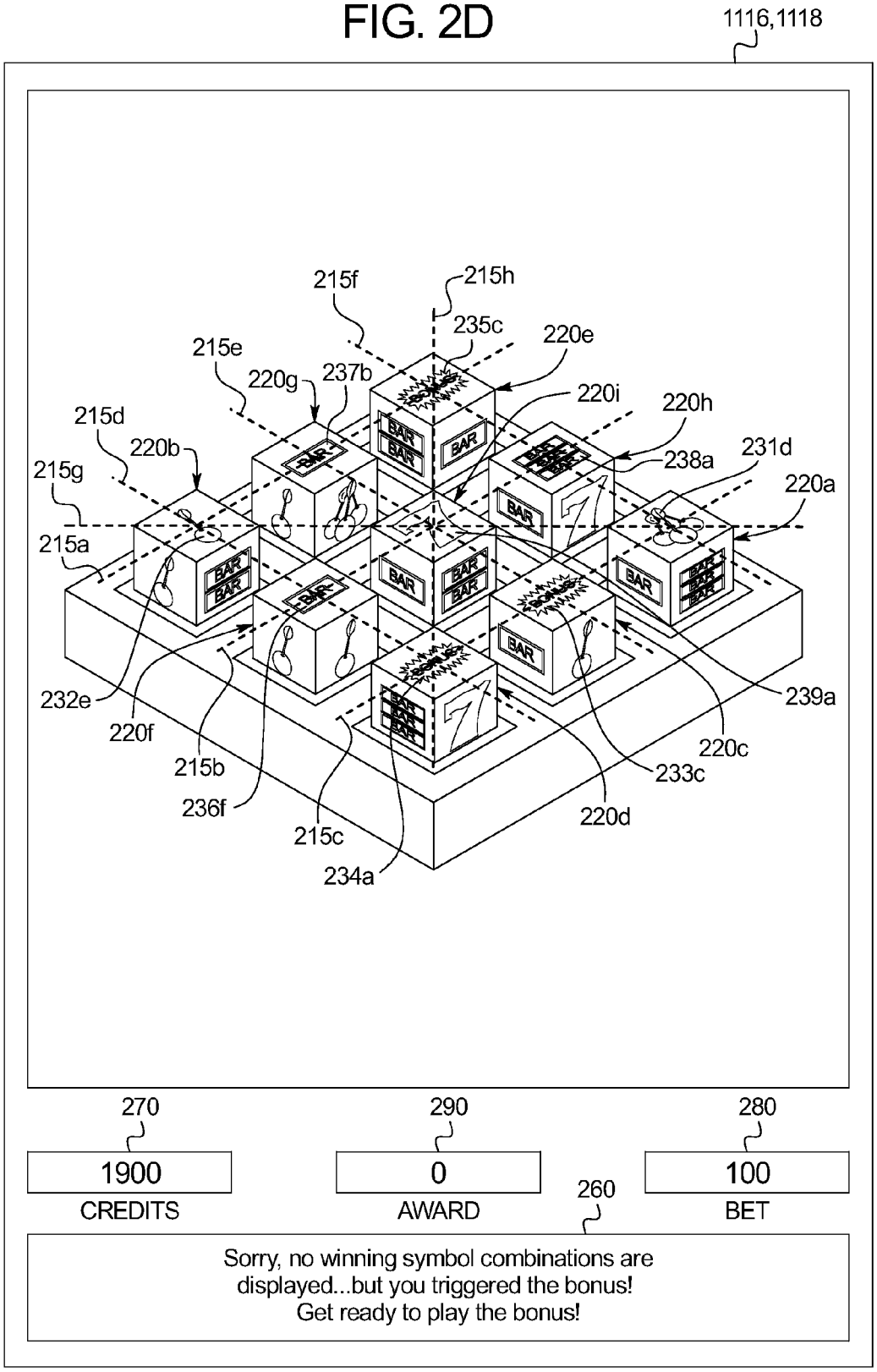

FIGS. 2B, 2C, and 2D illustrate screen shots of a play of this example embodiment of the slot game. In this example embodiment, the gaming system displays, such as on a display device 1116 or 1118 (described below), a plurality of object display areas including object display areas 210*a*, 210*b*, 210*c*, 210*d*, 210*e*, 210*f*, 210*g*, 210*h*, and 210*i* arranged in a 3×3 grid or matrix. Each of the object display areas is configured to display one of the objects 220*a*, 220*b*, 220*c*, 220*d*, 220*e*, 220*f*, 220*g*, 220*h*, and 220*i* such that one of the sides of the displayed object faces upward. It should be appreciated that, in other embodiments, the quantity of object display areas may be any suitable quantity and the object display areas may be arranged in any suitable manner. For instance, in other embodiments: (a) the gaming system displays twenty-five object display areas arranged in a 5×5 grid or matrix, (b) the gaming system displays one hundred object display areas arranged in a 10×10 grid or matrix, and (c) the gaming system displays four hundred object display areas arranged in a 20×20 grid or matrix.

The gaming system displays a plurality of paylines 215*a*, 215*b*, 215*c*, 215*d*, 215*e*, 215*f*, 215*g*, and 215*h*, each of which is associated with a different plurality of the object display areas. In this example embodiment: (a) the payline 215*a* is associated with the object display areas 210*a*, 210*b*, and 210*c*; (b) the payline 215*b* is associated with the object display areas 210*d*, 210*e*, and 210*f*; and (c) the payline 215*c* is associated with the object display areas 210*g*, 210*h*, and 210*i*; (d) the payline 215*d* is associated with the object display areas 210*a*, 210*d*, and 210*g*; (e) the payline 215*e* is associated with the object display areas 210*b*, 210*e*, and 210*h*; (f) the payline 215*f* is associated with the object display areas 210*c*, 210*f*, and 210*i*; (g) the payline 215*g* is associated with the object display areas 210*a*, 210*e*, and 210*i*; and (h) the payline 210*h* is associated with the object display areas 210*g*, 210*e*, and 210*c*.

The gaming system also displays: (a) a message box 260 in which the gaming system displays a variety of messages or indications before, during, or after play of the slot game; and (b) a plurality of meters including: (i) a credit meter 270 in which the gaming system displays the player's credit balance (in credit or currency form), (ii) a wager or bet meter 280 that displays any wager or bet placed on a play of the slot game (in credit or currency form), and (iii) an award meter 290 that displays any awards won during the play of the slot game (in credit or currency form). While in this illustrated example the gaming system indicates the player's credit balance, any wagers, and any awards in the form of amounts of currency, it should be appreciated that such indications may alternatively or additionally be made in the form of amounts of credits.

Turning to FIG. 2B, the gaming system receives value from the player; establishes the player's credit balance of 2,000 credits, which represents the received value; and receives a wager of 100 credits for a play of the slot game (as shown in the wager meter 280). The gaming system updates the player's credit balance to account for the 100 credit wager (as shown in the credit meter 270). The gaming system displays the following message in the message box 260: "YOU BET 100 CREDITS . . . GOOD LUCK!"

As illustrated in FIG. 2C, the gaming system displays each of the objects being tossed or thrown out of the object display areas and into the air to indicate that the objects will be randomly associated with the object display areas. In other words, the gaming system displays the objects being tossed into the air to indicate that each object (and, therefore each symbol set) is not, at this point in time, permanently associated with any given object display area in this example embodiment. It should be appreciated that, in other embodiments, the gaming system employs any suitable display to indicate that certain of the objects (and, therefore, the symbol sets associated with the objects) are not permanently associated with any particular object display areas. The gaming system displays the following message in the message box 260: "PLEASE WAIT FOR THE BLOCKS TO LAND . . . "

For this play of the slot game, the gaming system randomly associates: (a) the object 220*b* (and, therefore, the symbol set associated with the object 220*b*) with the object display area 210*a*; (b) the object 220*g* (and, therefore, the symbol set associated with the object 220*g*) with the object display area 210*b*; (c) the object 220*e* (and, therefore, the symbol set associated with the object 220*e*) with the object display area 210*c*; (d) the object 220*f* (and, therefore, the symbol set associated with the object 220*f*) with the object display area 210*d*; (e) the object 220*i* (and, therefore, the symbol set associated with the object 220*i*) with the object display area 210*e*; (f) the object 220*h* (and, therefore, the symbol set associated with the object 220*h*) with the object display area 210*f*; (g) the object 220*d* (and, therefore, the symbol set associated with the object 220*d*) with the object display area 210*g*; (h) the object 220*c* (and, therefore, the symbol set associated with the object 220*c*) with the object display area 210*h*; and (i) the object 220*a* (and, therefore, the symbol set associated with the object 220*a*) with the object display area 210*i*.

Additionally, for this play of the slot game, the gaming system randomly selects: (a) the Cherry symbol 232*e* of the object 220*b*, (b) the Bar symbol 237*b* of the object 220*g*, (c) the Bonus symbol 235*c* of the object 220*e*, (d) the Bar symbol 236*f* of the object 220*f*, (e) the Seven symbol 239*a* of the object 220*i*, (f) the Triple Bar symbol 238*a* of the object 220*h*, (g) the Bonus symbol 234*a* of the object 220*d*, (h) the Bonus symbol 233*c* of the object 220*c*, and (i) the Triple Cherry symbol 231*d* of the object 220*a*.

Accordingly, as shown in FIG. 2D, the gaming system displays: (a) the object 220*b* at the object display area 210*a* such that the Cherry symbol 232*e* faces upward, (b) the object 220*g* at the object display area 210*b* such that the Bar symbol 237*b* faces upward, (c) the object 220*e* at the object display area 210*c* such that the Bonus symbol 235*c* faces upward, (d) the object 220*f* at the object display area 210*d* such that the Bar symbol 236*f* faces upward, (e) the object 220*i* at the object display area 210*e* such that the Seven symbol 239*a* faces upward, (f) the object 220*h* at the object display area 210*f* such that the Triple Bar symbol 238*a* faces upward, (g) the object 220*d* at the object display area 210*g* such that the Bonus symbol 234*a* faces upward, (h) the object 220*c* at the object display area 210*h* such that the Bonus symbol 233*c* faces upward, and (i) the objet 220*a* at the object display area 210*i* such that the Triple Cherry symbol 231*d* faces upward.

The gaming system makes an award determination based on the upwardly-facing symbols and a paytable associated with the slot game (not shown). More specifically, the gaming system determines whether any of a plurality of winning symbol combinations included in the paytable are displayed along any of the paylines 215*a*, 215*b*, 215*c*, 215*d*, 215*e*, 215*f*, 215*g*, and/or 215*h*. In this example embodiment, the gaming system determines that none of the winning symbol combinations are displayed along any of the paylines and, therefore, not to provide any awards for this play of the slot game. The gaming system also determines whether the bonus triggering event occurred in association with this play of the slot game. Since three Bonus symbols are displayed facing upward in a scatter configuration, the gaming system determines that the bonus triggering event occurred and, therefore, to provide the bonus. The gaming system displays the following message in the message box 260: "SORRY, NO WINNING SYMBOL COMBINATIONS ARE DISPLAYED . . . BUT YOU TRIGGERED THE BONUS! GET READY TO PLAY THE BONUS!"

FIGS. 3A, 3B, 3C, 3D, 3E, 3F, 3G, 3H, 3I, 3J, 3K, and 3L illustrate one example embodiment of the slot game of the present disclosure implemented in the bonus. As described in detail below, in this example embodiment, in the bonus, the slot game is associated with nine different bonus sets of symbols or bonus symbol sets, each of which is associated with six symbols. Each of the bonus symbol sets is represented by a six-sided bonus object. For each of the bonus objects, each of the sides of that bonus object displays one of the six symbols of the bonus symbol set represented by that bonus object. In this example embodiment, the bonus symbol sets are different than the symbol sets employed for the primary slot game.

For a play of the bonus in this example embodiment, the gaming system provides a designated quantity (five in this example embodiment) of free tosses or throws of the bonus objects (i.e., free plays of the slot game). In this example embodiment, the gaming system evaluates the symbols displayed facing upward following the first free toss and determines how many upwardly-facing symbols (if any) match one another. The gaming system designates the symbol having the most matches as a locking symbol for the duration of the bonus. If two symbols have the same quantity of matches, the gaming system designates the higher value symbol as the locking symbol in this example embodiment. In this example embodiment, if the gaming system does not display any matching symbols facing upward following the first free toss, the gaming system designates the displayed symbol having a designated value (such as the highest value) as the locking symbol. Whenever a locking symbol is displayed following a free toss (including following the first free toss), the gaming system locks or holds the bonus object displaying that locking symbol at the object display area at which that bonus object is displayed for the remaining free tosses such that that bonus object displays that locking symbol facing upward for the remaining free tosses.

For instance, if, following the first free toss, two Jackpot symbols are displayed facing upward, three Seven symbols are displayed facing upward, two Double Bar symbols are displayed facing upward, one Triple Cherry symbol is displayed facing upward, and one Cherry symbol is displayed facing upward, the gaming system designates the Seven symbol as the locking symbol because the Seven symbol is the upwardly-facing symbol with the most matches. The gaming system locks the bonus objects displaying the upwardly-facing Seven symbols at the object display areas at which those bonus objects are displayed for the remaining free tosses such that those bonus objects display the Seven symbols facing upward for the remaining free tosses. Put differently, for at least the second free toss, the gaming system tosses the bonus objects that displayed the Jackpot symbols, the Double Bar symbols, the Triple Cherry symbol, and the Cherry symbol facing upward (i.e., that display the non-locking symbols facing upward), and does not toss the bonus objects that displayed the Seven symbols facing upward.

In this example embodiment, if a designated quantity of the bonus objects displays the Jackpot symbol facing upward as a result of one of the free tosses, the gaming system determines a jackpot award (such as a progressive award or one of a plurality of progressive awards of a multi-level progressive (MLP)) and displays the determined jackpot award. In this example embodiment, the designated quantity includes all of the bonus objects, though it should be appreciated that any other suitable designated quantity may be employed. It should be appreciated that the gaming system may provide any other suitable award and/or additional award opportunity if the designated quantity of the bonus objects displays the Jackpot symbol facing upward as a result of one of the free tosses.

Figure 3A:
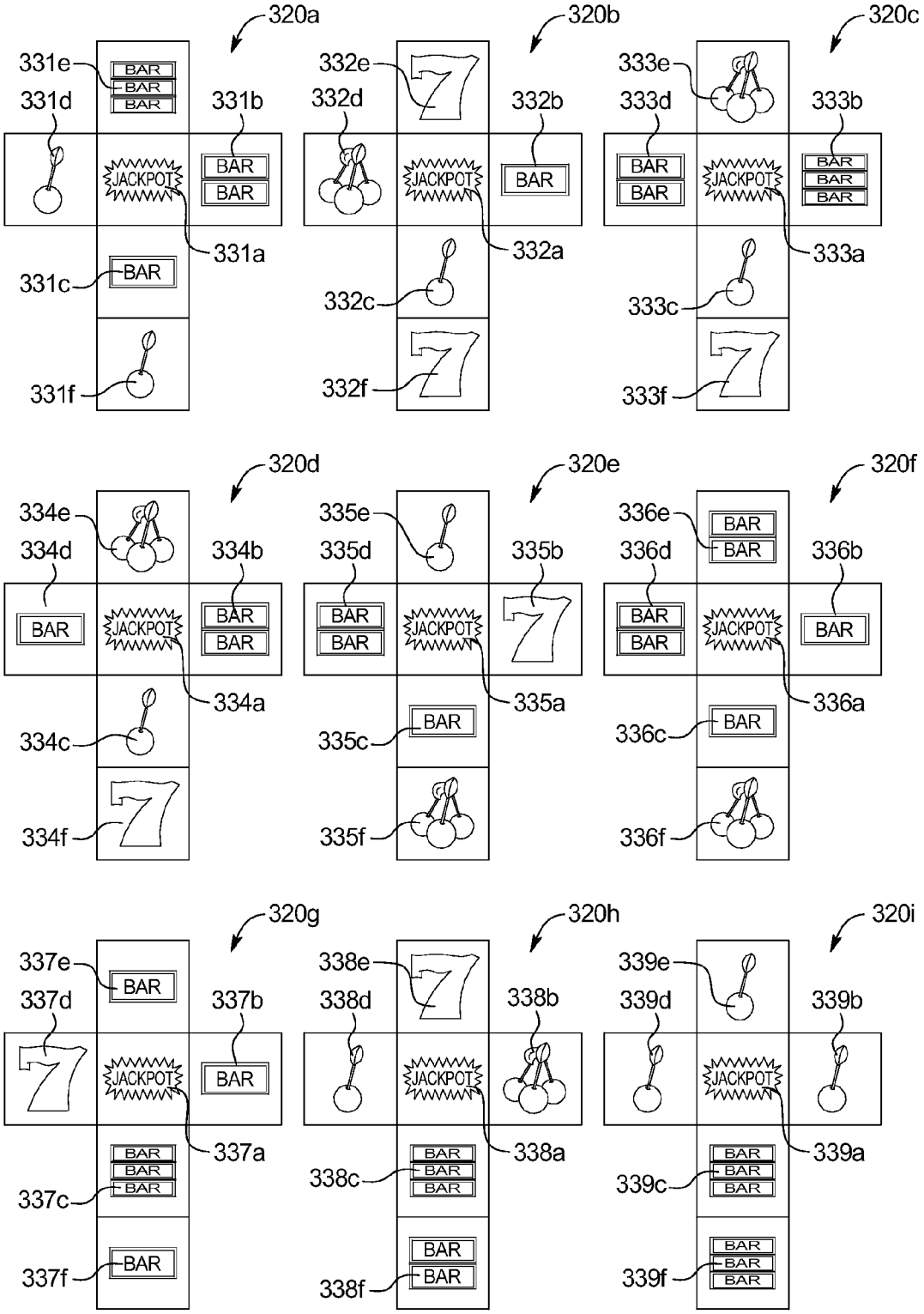
FIGS. 3A, 3B, 3C, 3D, 3E, 3F, 3G, 3H, 3I, 3J, 3K, and 3L illustrate one example embodiment of the slot game of the present disclosure implemented in a bonus.

As noted above, each of the bonus objects represents and displays the symbols included in one of the bonus symbol sets associated with the slot game in the bonus. Turning to FIG. 3A, FIG. 3A illustrates each of the nine bonus objects 320*a*, 320*b*, 320*c*, 320*d*, 320*e*, 320*f*, 320*g*, 320*h*, and 320*i* in a "flattened" state such that each of the six symbols associated with each of the bonus objects (and, therefore, each of the symbols of each of the nine bonus symbol sets) is shown. More specifically, in this example embodiment: (a) the bonus object 320*a* (and the bonus symbol set associated with the bonus object 320*a*) includes Jackpot symbol 331*a*, Double Bar symbol 331*b*, Bar symbol 331*c*, Cherry symbol 331*d*, Triple Bar symbol 331*e*, and Cherry symbol 331*f*; (b) the bonus object 320*b* (and the bonus symbol set associated with the bonus object 320*b*) includes Jackpot symbol 332*a*, Bar symbol 332*b*, Cherry symbol 332*c*, Triple Cherry symbol 332*d*, Seven symbol 332*e*, and Seven symbol 332*f*; (c) the bonus object 320*c* (and the bonus symbol set associated with the bonus object 320*c*) includes Jackpot symbol 333*a*, Triple Bar symbol 333*b*, Cherry symbol 333*c*, Double Bar symbol 333*d*, Triple Cherry symbol 333*e*, and Seven symbol 333*f*; (d) the bonus object 320*d* (and the bonus symbol set associated with the bonus object 320*d*) includes Jackpot symbol 334*a*, Double Bar symbol 334*b*, Cherry symbol 334*c*, Bar symbol 334*d*, Triple Cherry symbol 334*e*, and Seven symbol 334*f*; (e) the bonus object 320*e* (and the bonus symbol set associated with the bonus object 320*e*) includes Jackpot symbol 335*a*, Seven symbol 335*b*, Bar symbol 335*c*, Double Bar symbol 335*d*, Cherry symbol 335*e*, and Triple Cherry symbol 335*f*; (f) the bonus object 320*f* (and the bonus symbol set associated with the bonus object 320*f*) includes Jackpot symbol 336*a*, Bar symbol 336*b*, Bar symbol 336*c*, Double Bar symbol 336*d*, Double Bar symbol 336*e*, and Triple Cherry symbol 336*f*; (g) the bonus object 320*g* (and the bonus symbol set associated with the bonus object 320*g*) includes Jackpot symbol 337*a*, Bar symbol 337*b*, Triple Bar symbol 337*c*, Seven symbol 337*d*, Bar symbol 337*e*, and Bar symbol 337*f*; (h) the bonus object 320*h* (and the bonus symbol set associated with the bonus object 320*h*) includes Jackpot symbol 338*a*, Triple Cherry symbol 338*b*, Triple Bar symbol 338*c*, Cherry symbol 338*d*, Seven symbol 338*e*, and Double Bar symbol 338*f*; and (i) the bonus object 320*i* (and the bonus symbol set associated with the bonus object 320*i*) includes Jackpot symbol 339*a*, Cherry symbol 339*b*, Triple Bar symbol 339*c*, Cherry symbol 339*d*, Cherry symbol 339*e*, and Triple Bar symbol 339*f*.

FIGS. 3B, 3C, 3D, 3E, 3F, 3G, 3H, 3I, 3J, 3K, and 3L illustrate screen shots of a play of the bonus of this example embodiment. For a play of the bonus in this example embodiment, the gaming system displays a plurality of object display areas including object display areas 310*a*, 310*b*, 310*c*, 310*d*, 310*e*, 310*f*, 310*g*, 310*h*, and 310*i* arranged in a 3×3 grid or matrix. Each of the object display areas is configured to display one of the bonus objects 320*a*, 320*b*, 320*c*, 320*d*, 320*e*, 320*f*, 320*g*, 320*h*, and 320*i* such that one of the sides of the displayed bonus object faces upward. The gaming system displays a plurality of paylines 315*a*, 315*b*, 315*c*, 315*d*, 315*e*,

315*f*, 315*g*, and 315*h*, each of which is associated with a different plurality of the object display areas. In this example embodiment: (a) the payline 315*a* is associated with the object display areas 310*a*, 310*b*, and 310*c*; (b) the payline 315*b* is associated with the object display areas 310*d*, 310*e*, and 310*f*; and (c) the payline 315*c* is associated with the object display areas 310*g*, 310*h*, and 310*i*; (d) the payline 315*d* is associated with the object display areas 310*a*, 310*d*, and 310*g*; (e) the payline 315*e* is associated with the object display areas 310*b*, 310*e*, and 310*h*; (f) the payline 315*f* is associated with the object display areas 310*c*, 310*f*, and 310*i*; (g) the payline 315*g* is associated with the object display areas 310*a*, 310*e*, and 310*i*; and (h) the payline 310*h* is associated with the object display areas 310*g*, 310*e*, and 310*c*.

The gaming system also displays: (a) a message box 360 (described above); and (b) a plurality of meters including: (i) a total bonus award meter 390 that displays any awards won during the play of the bonus (in credit or currency form); and (ii) a free tosses remaining meter that displays the number of free tosses to be provided to the player.

Figure 3B:
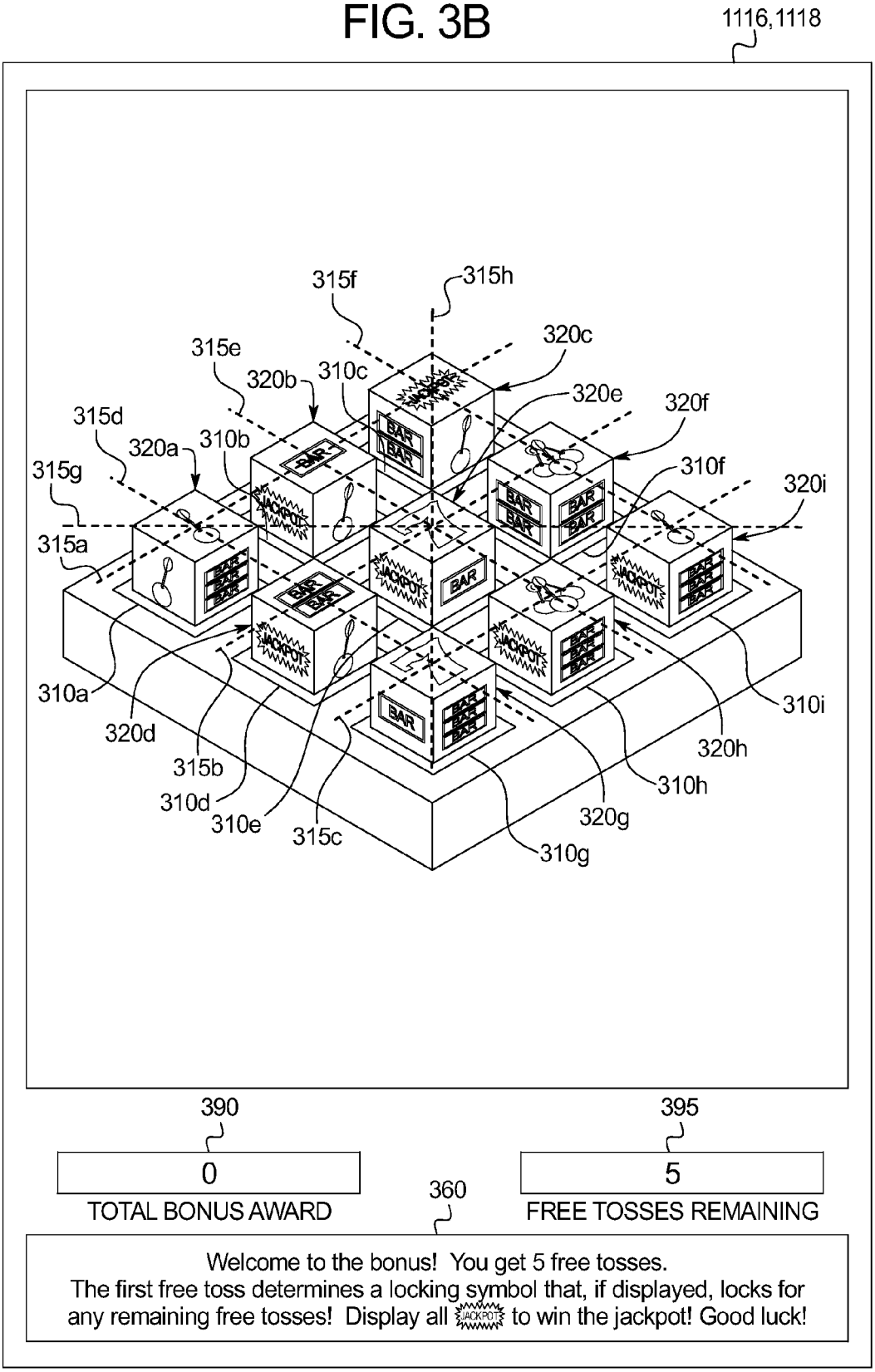

Turning to FIG. 3B, after triggering the bonus, the gaming system provides the player with five free tosses (i.e., free plays of the slot game), as indicated by the free tosses remaining meter 395. The gaming system gaming system displays the following message in the message box 360: "WELCOME TO THE BONUS! YOU GET 5 FREE TOSSES. THE FIRST FREE TOSS DETERMINES A LOCKING SYMBOL THAT, IF DISPLAYED, LOCKS FOR ANY REMAINING FREE TOSSES! DISPLAY ALL JACKPOT SYMBOLS TO WIN THE JACKPOT! GOOD LUCK!"

Figure 3C:
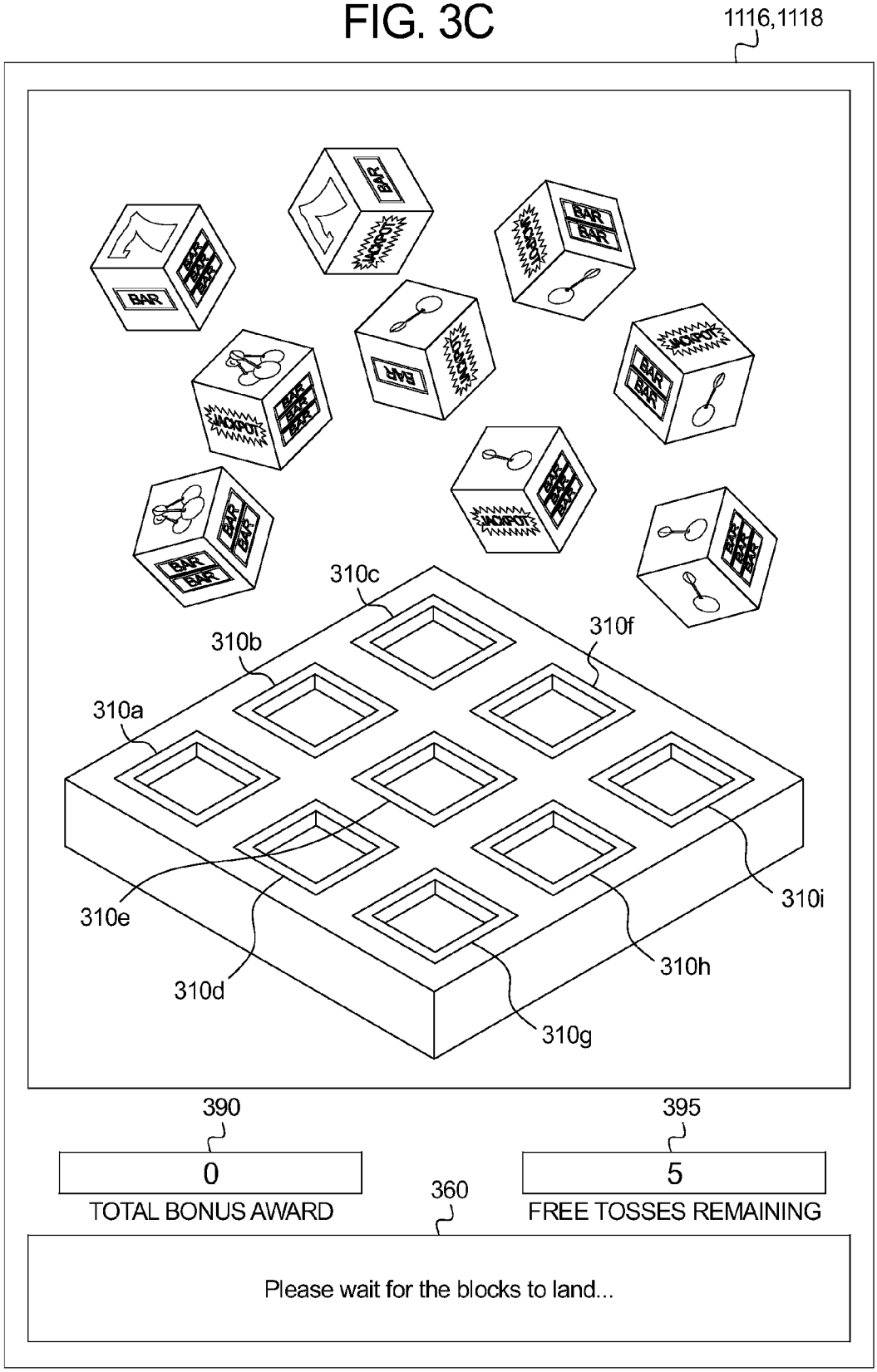

As illustrated in FIG. 3C, for the first free toss, the gaming system displays each of the bonus objects being tossed or thrown out of the object display areas and into the air to indicate that the bonus objects will be randomly associated with the object display areas. In other words, the gaming system displays the objects being tossed into the air to indicate that each bonus object (and, therefore each bonus symbol set) is, at this point in time, not permanently associated with any given object display area. The gaming system displays the following message in the message box 360: "PLEASE WAIT FOR THE BLOCKS TO LAND . . . "

For the first free toss, the gaming system randomly associates: (a) the bonus object 320*b* (and, therefore, the bonus symbol set associated with the bonus object 320*b*) with the object display area 310*a*; (b) the bonus object 320*i* (and, therefore, the bonus symbol set associated with the bonus object 320*i*) with the object display area 310*b*; (c) the bonus object 320*h* (and, therefore, the bonus symbol set associated with the bonus object 320*h*) with the object display area 310*c*; (d) the bonus object 320*g* (and, therefore, the bonus symbol set associated with the bonus object 320*g*) with the object display area 310*d*; (e) the bonus object 320*d* (and, therefore, the bonus symbol set associated with the bonus object 320*d*) with the object display area 310*e*; (f) the bonus object 320*f* (and, therefore, the bonus symbol set associated with the bonus object 320*f*) with the object display area 310*f*; (g) the bonus object 320*c* (and, therefore, the bonus symbol set associated with the bonus object 320*c*) with the object display area 310*g*; (h) the bonus object 320*a* (and, therefore, the bonus symbol set associated with the bonus object 320*a*) with the object display area 310*h*; and (i) the bonus object 320*e* (and, therefore, the bonus symbol set associated with the bonus object 320*e*) with the object display area 310*i*.

Additionally, for the first free toss, the gaming system randomly selects: (a) the Jackpot symbol 332*a* of the bonus object 320*b*, (b) the Cherry symbol 339*b* of the bonus object 320*i*, (c) the Cherry symbol 338*d* of the object 320*h*, (d) the Seven symbol 337*d* of the bonus object 320*g*, (e) the Seven symbol 334*f* of the bonus object 320*f*, (f) the Bar symbol 336*b* of the bonus object 320*f*, (g) the Jackpot symbol 333*a* of the bonus object 320*c*, (h) the Jackpot symbol 331*a* of the bonus object 320*a*, and (i) the Double Bar symbol 335*d* of the bonus object 320*c*.

Figure 3D:
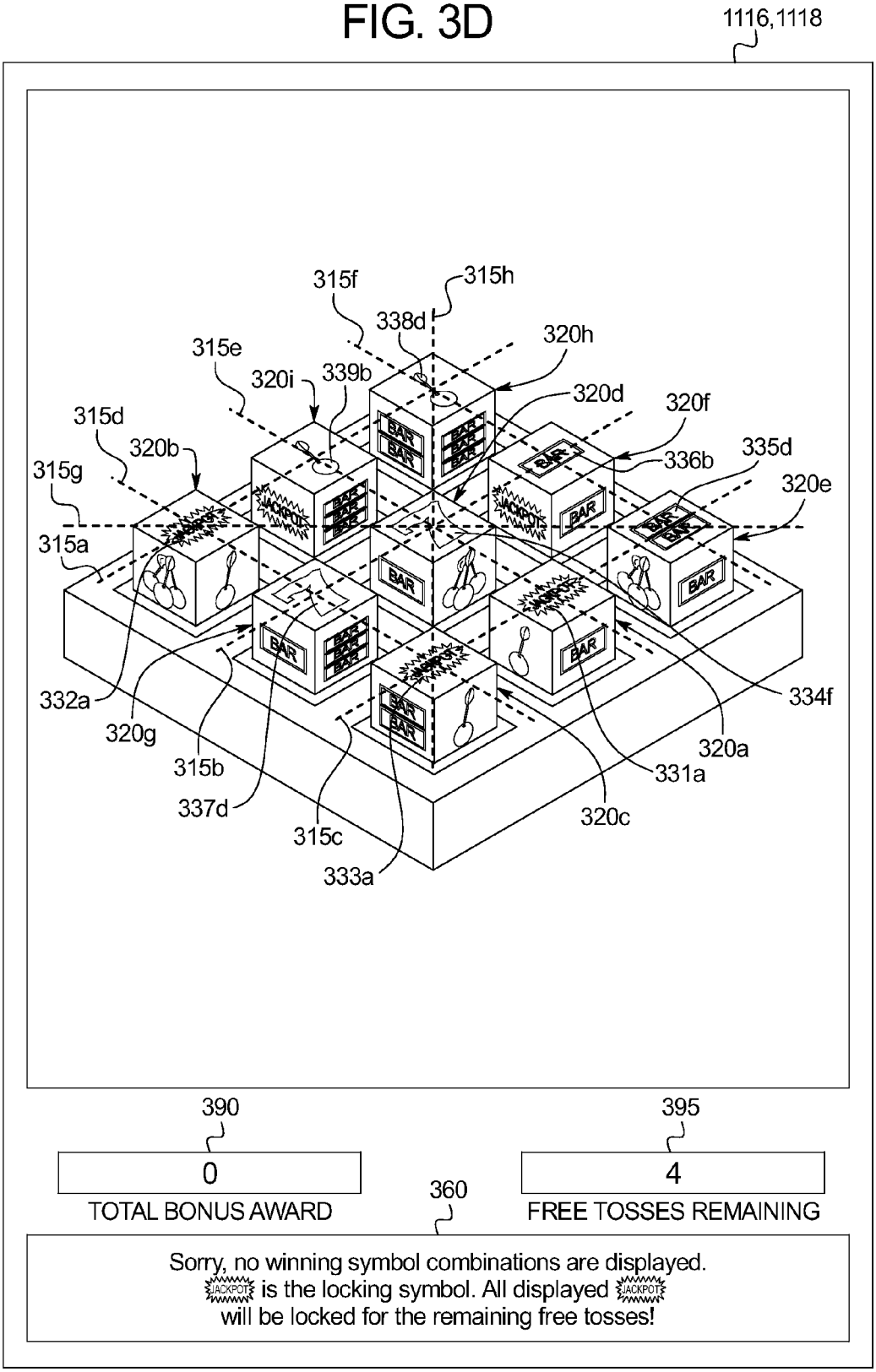

Accordingly, as shown in FIG. 3D, the gaming system displays: (a) the bonus object 320*b* at the object display area 310*a* such that the Jackpot symbol 332*a* faces upward, (b) the bonus object 320*i* at the object display area 310*b* such that the Cherry symbol 339*b* faces upward, (c) the bonus object 320*h* at the object display area 310*c* such that the Cherry symbol 338*d* faces upward, (d) the bonus object 320*g* at the object display area 310*d* such that the Seven symbol 337*d* faces upward, (e) the bonus object 320*d* at the object display area 310*e* such that the Seven symbol 334*f* faces upward, (f) the bonus object 320*f* at the object display area 310*f* such that the Bar symbol 336*b* faces upward, (g) the bonus object 320*c* at the object display area 310*g* such that the Jackpot symbol 333*a* faces upward, (h) the bonus object 320*a* at the object display area 310*h* such that the Jackpot symbol 331*a* faces upward, and (i) the bonus object 320*e* at the object display area 310*i* such that the Double Bar symbol 335*d* faces upward.

The gaming system makes an award determination based on the displayed (i.e., upwardly-facing) symbols and a paytable associated with the slot game for the bonus (not shown). More specifically, the gaming system determines whether any of a plurality of winning symbol combinations included in the paytable are displayed along any of the paylines 315*a*, 315*b*, 315*c*, 315*d*, 315*e*, 315*f*, 315*g*, and/or 315*h*. In this example embodiment, the gaming system determines that none of the winning symbol combinations are displayed along any of the paylines and, therefore, not to provide any awards for the first free toss.

As noted above, since this is the first free toss, the gaming system evaluates the displayed symbols (i.e., the outcome of the first free toss) to determine the locking symbol for the bonus. In this example embodiment, the gaming system determines that: (a) three matching Jackpot symbols are displayed facing upward, (b) two matching Seven symbols are displayed facing upward, and (c) two matching Cherry symbols are displayed facing upward. Since the Jackpot symbol has the most matches, the gaming system designates the Jackpot symbol as the locking symbol for the bonus. Thus, whenever a bonus object displays the Jackpot symbol facing upward, the gaming system locks or holds the bonus object displaying the Jackpot symbol at the object display area at which that bonus object is displayed for the remaining free tosses such that that bonus object displays the Jackpot symbol facing upward for the remaining free tosses.

Accordingly, following the first free toss, the gaming system locks: (a) the bonus object 320*b* at the object display area 310*a* such that the Jackpot symbol 332*a* faces upward for the remaining free tosses, (b) the bonus object 320*c* at the object display area 310*g* such that the Jackpot symbol 333*a* faces upward for the remaining free tosses, and (c) the bonus object 320*a* at the object display area 310*h* such that the Jackpot symbol 331*a* faces upward for the remaining free tosses. The gaming system updates the free tosses remaining meter 395 to indicate that four free tosses remain. The gaming system displays the following message in the message box 360: "SORRY, NO WINNING SYMBOL COMBINATIONS ARE DISPLAYED. THE JACKPOT SYMBOL IS THE LOCKING SYMBOL. ALL DISPLAYED JACKPOT SYMBOLS WILL BE LOCKED FOR THE REMAINING FREE TOSSES!"

Figure 3E:
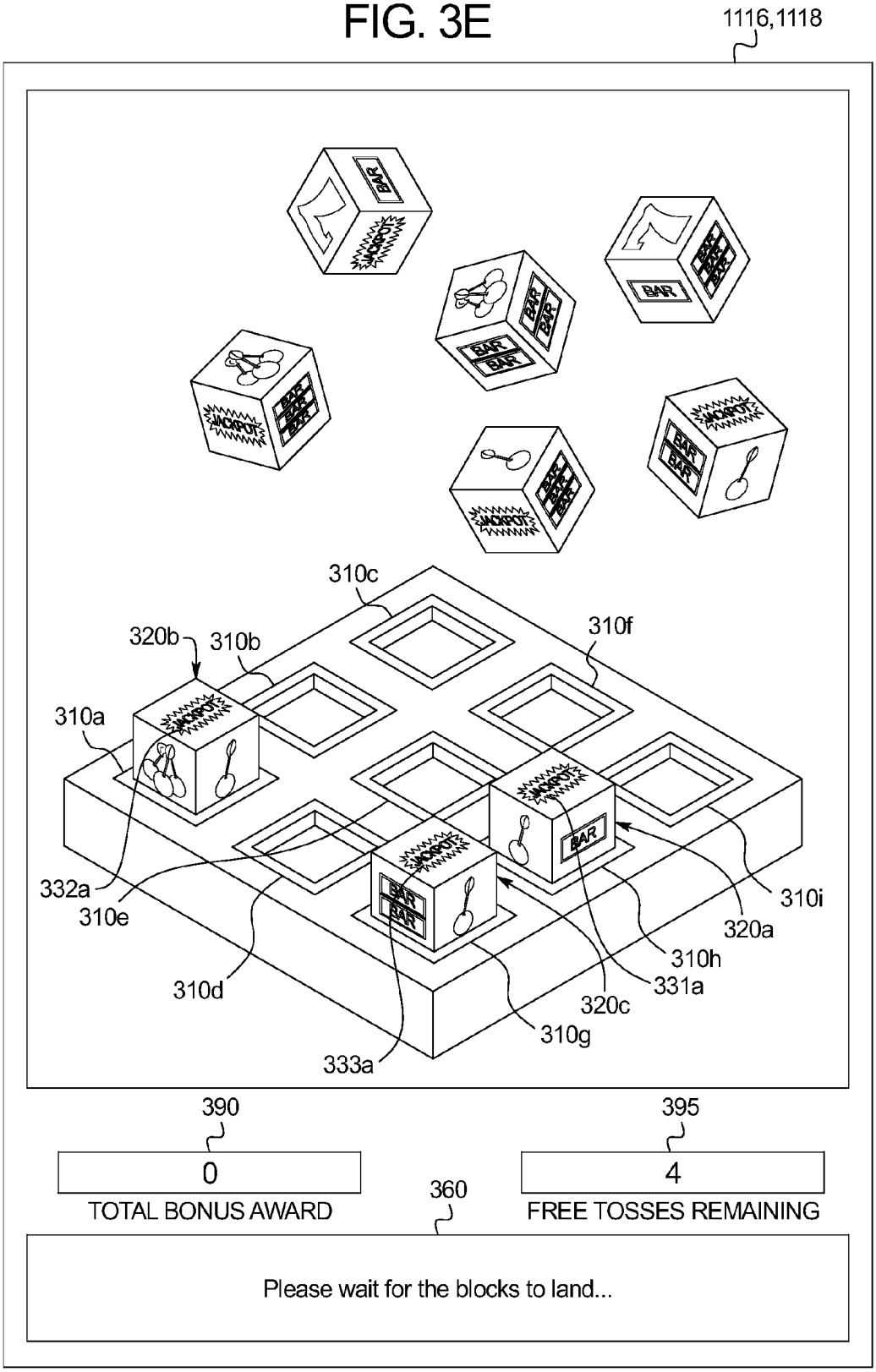

As illustrated in FIG. 3E, for the second free toss, the gaming system displays each of the non-locked bonus objects being tossed out of the object display areas and into the air to indicate that those bonus objects will be randomly associated with the object display areas. In other words, the gaming system displays those bonus objects being tossed into the air to indicate that those bonus objects (and, therefore the bonus symbol sets associated with those bonus objects) are, at this point in time, not permanently associated with any given object display areas. The gaming system displays the following message in the message box 360: "PLEASE WAIT FOR THE BLOCKS TO LAND . . . "

For the second free toss, the gaming system randomly associates: (a) the bonus object 320*d* (and, therefore, the bonus symbol set associated with the bonus object 320*d*) with the object display area 310*b*; (b) the bonus object 320*f* (and, therefore, the bonus symbol set associated with the bonus object 320*f*) with the object display area 310*c*; (c) the bonus object 320*g* (and, therefore, the bonus symbol set associated with the bonus object 320*g*) with the object display area 310*d*; (d) the bonus object 320*e* (and, therefore, the bonus symbol set associated with the bonus object 320*e*) with the object display area 310*e*; (e) the bonus object 320*h* (and, therefore, the bonus symbol set associated with the bonus object 320*h*) with the object display area 310*f*; and (f) the bonus object 320*i* (and, therefore, the bonus symbol set associated with the bonus object 320*i*) with the object display area 310*i*.

Additionally, for the second free toss, the gaming system randomly selects: (a) the Bar symbol 334*d* of the bonus object 320*d*, (b) the Double Bar symbol 336*d* of the bonus object 320*f*, (c) the Jackpot symbol 337*a* of the bonus object 320*g*, (d) the Jackpot symbol 335*a* of the bonus object 320*e*, (e) the Cherry symbol 338*d* of the bonus object 320*h*, and (f) the Cherry symbol 339*b* of the bonus object 320*i*.

Figure 3F:
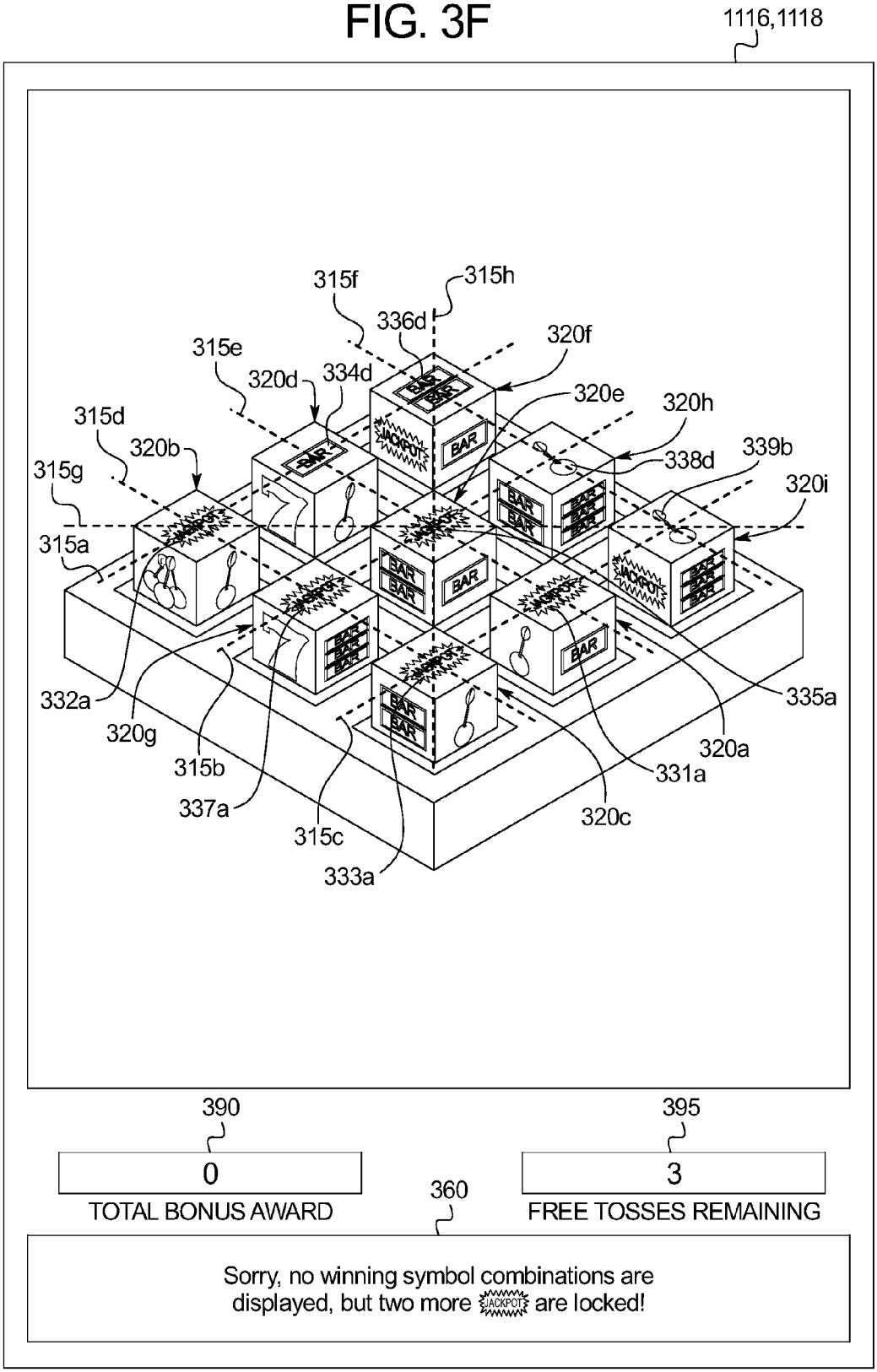

Accordingly, as shown in FIG. 3F, the gaming system displays: (a) the bonus object 320*b* at the object display area 310*a* such that the Jackpot symbol 332*a* faces upward, (b) the bonus object 320*d* at the object display area 310*b* such that the Bar symbol 334*d* faces upward, (c) the bonus object 320*f* at the object display area 310*c* such that the Double Bar symbol 336*d* faces upward, (d) the bonus object 320*g* at the object display area 310*d* such that the Jackpot symbol 337*a* faces upward, (e) the bonus object 320*e* at the object display area 310*e* such that the Jackpot symbol 335*a* faces upward, (f) the bonus object 320*h* at the object display area 310*f* such that the Cherry symbol 338*d* faces upward, (g) the bonus object 320*c* at the object display area 310*g* such that the Jackpot symbol 333*a* faces upward, (h) the bonus object 320*a* at the object display area 310*h* such that the Jackpot symbol 331*a* faces upward, and (i) the bonus object 320*i* at the object display area 310*i* such that the Cherry symbol 339*b* faces upward.

The gaming system makes an award determination based on the displayed upwardly-facing symbols and the paytable associated with the slot game for the bonus. More specifically, the gaming system determines whether any of the plurality of winning symbol combinations included in the paytable are displayed along any of the paylines 315*a*, 315*b*, 315*c*, 315*d*, 315*e*, 315*f*, 315*g*, and/or 315*h*. In this example embodiment, the gaming system determines that none of the winning symbol combinations are displayed along any of the paylines and, therefore, not to provide any awards for the second free toss.

As noted above, the Jackpot symbol is the locking symbol. Accordingly, following the second free toss, the gaming system: (a) continues to lock: (i) the bonus object 320*b* at the object display area 310*a* such that the Jackpot symbol 332*a* faces upward for the remaining free tosses, (ii) the bonus object 320*c* at the object display area 310*g* such that the Jackpot symbol 333*a* faces upward for the remaining free tosses, and (iii) the bonus object 320*a* at the object display area 310*h* such that the Jackpot symbol 331*a* faces upward for the remaining free tosses; and (b) locks: (i) the bonus object 320*g* at the object display area 310*d* such that the Jackpot symbol 337*a* faces upward for the remaining free tosses, and (ii) the bonus object 320*e* at the object display area 310*e* such that the Jackpot symbol 335*a* faces upward for the remaining free tosses. The gaming system updates the free tosses remaining meter 395 to indicate that three free tosses remain. The gaming system displays the following message in the message box 360: "SORRY, NO WINNING SYMBOL COMBINATIONS ARE DISPLAYED, BUT TWO MORE JACKPOT SYMBOLS ARE LOCKED!"

Figure 3G:
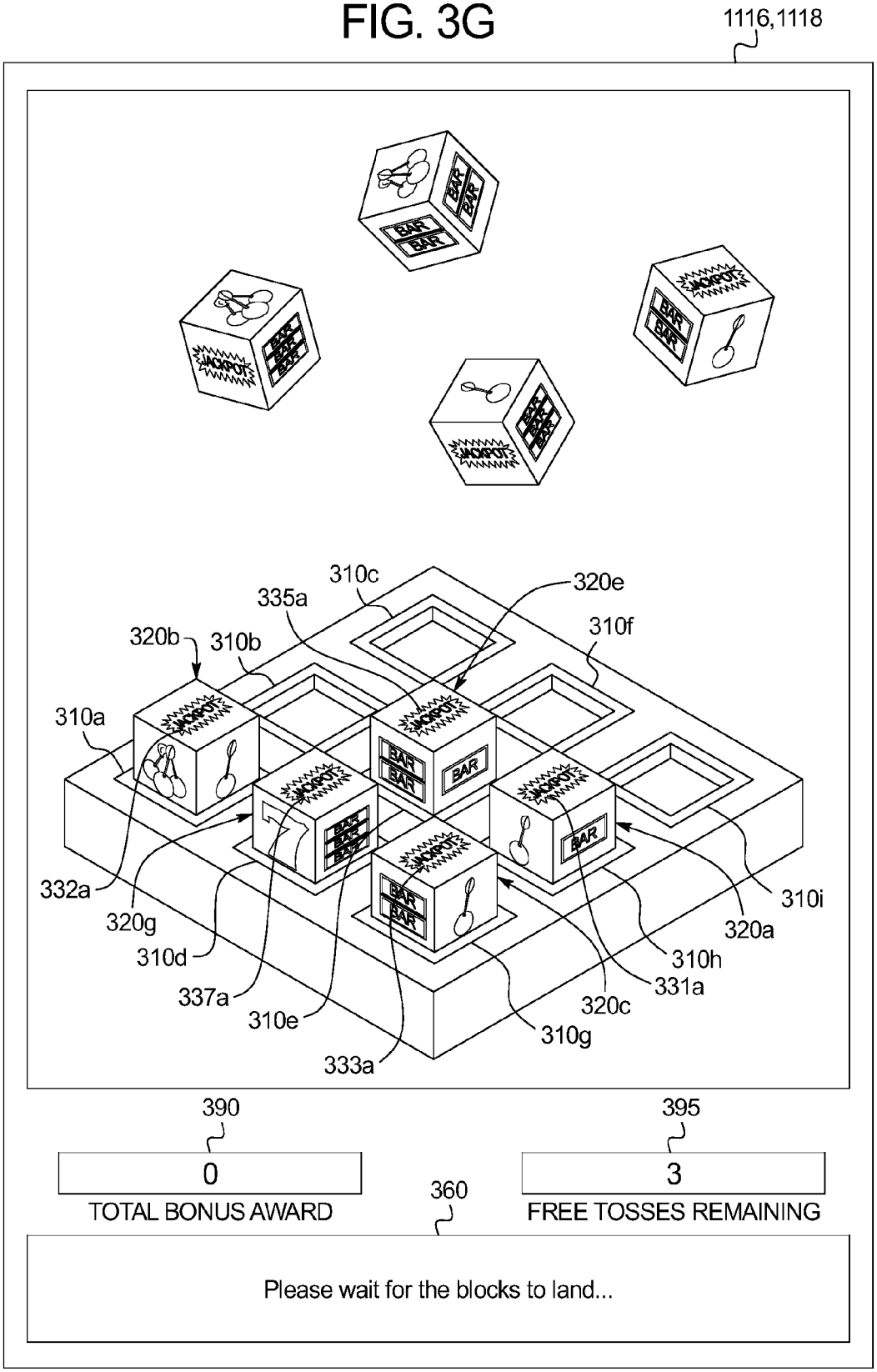

As illustrated in FIG. 3G, for the third free toss, the gaming system displays each of the non-locked bonus objects being tossed out of the object display areas and into the air to indicate that those bonus objects will be randomly associated with the object display areas. In other words, the gaming system displays those bonus objects being tossed into the air to indicate that those bonus objects (and, therefore the bonus symbol sets associated with those bonus objects) are, at this point in time, not permanently associated with any given object display areas. The gaming system displays the following message in the message box 360: "PLEASE WAIT FOR THE BLOCKS TO LAND . . . "

For the third free toss, the gaming system randomly associates: (a) the bonus object 320*i* (and, therefore, the bonus symbol set associated with the bonus object 320*i*) with the object display area 310*b*; (b) the bonus object 320*f* (and, therefore, the bonus symbol set associated with the bonus object 320*f*) with the object display area 310*c*; (c) the bonus object 320*d* (and, therefore, the bonus symbol set associated with the bonus object 320*d*) with the object display area 310*f*; and (f) the bonus object 320*h* (and, therefore, the bonus symbol set associated with the bonus object 320*h*) with the object display area 310*i*.

Additionally, for the third free toss, the gaming system randomly selects: (a) the Triple Bar symbol 339*f* of the bonus object 320*i*, (b) the Bar symbol 336*b* of the bonus object 320*f*, (c) the Jackpot symbol 334*a* of the bonus object 320*d*, and (d) the Jackpot symbol 338*a* of the bonus object 320*h*.

Figure 3H:
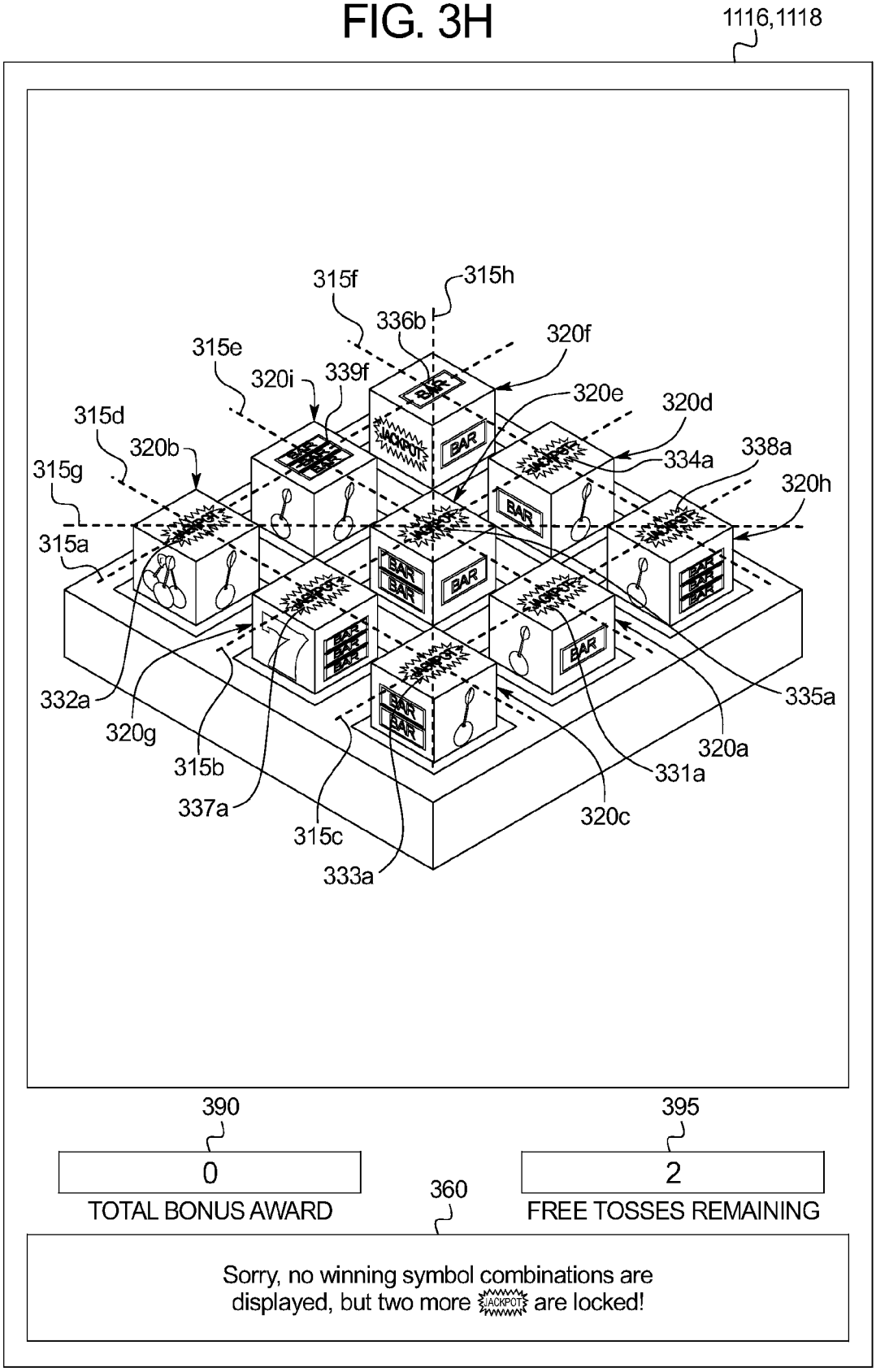

Accordingly, as shown in FIG. 3H, the gaming system displays: (a) the bonus object 320*b* at the object display area 310*a* such that the Jackpot symbol 332*a* faces upward, (b) the bonus object 320*i* at the object display area 310*b* such that the Triple Bar symbol 339*f* faces upward, (c) the bonus object 320*f* at the object display area 310*c* such that the Bar symbol 336*b* faces upward, (d) the bonus object 320*g* at the object display area 310*d* such that the Jackpot symbol 337*a* faces upward, (e) the bonus object 320*e* at the object display area 310*e* such that the Jackpot symbol 335*a* faces upward, (f) the bonus object 320*d* at the object display area 310*f* such that the Jackpot symbol 334*a* faces upward, (g) the bonus object 320*c* at the object display area 310*g* such that the Jackpot symbol 333*a* faces upward, (h) the bonus object 320*a* at the object display area 310*h* such that the Jackpot symbol 331*a* faces upward, and (i) the bonus object 320*h* at the object display area 310*i* such that the Jackpot symbol 338*a* faces upward.

The gaming system makes an award determination based on the displayed upwardly-facing symbols and the paytable associated with the slot game for the bonus. More specifically, the gaming system determines whether any of the plurality of winning symbol combinations included in the paytable are displayed along any of the paylines 315*a*, 315*b*, 315*c*, 315*d*, 315*e*, 315*f*, 315*g*, and/or 315*h*. In this example embodiment, the gaming system determines that none of the winning symbol combinations are displayed along any of the paylines and, therefore, not to provide any awards for the third free toss.

As noted above, the Jackpot symbol is the locking symbol. Accordingly, following the third free toss, the gaming system: (a) continues to lock: (i) the bonus object 320*b* at the object display area 310*a* such that the Jackpot symbol 332*a* faces upward for the remaining free tosses, (ii) the bonus object 320*c* at the object display area 310*g* such that the Jackpot symbol 333*a* faces upward for the remaining free tosses, (iii) the bonus object 320*a* at the object display area 310*h* such that the Jackpot symbol 331*a* faces upward for the remaining free tosses; (iv) the bonus object 320*g* at the object display area 310*d* such that the Jackpot symbol 337*a* faces upward for the remaining free tosses, and (v) the bonus object 320*e* at the object display area 310*e* such that the Jackpot symbol 335*a* faces upward for the remaining free tosses; and (b) locks: (i) the bonus object 320*d* at the object display area 310*f* such that the Jackpot symbol 334*a* faces upward for the remaining free tosses or throes, and (ii) the bonus object 320*h* at the object display area 310*i* such that the Jackpot symbol 338*a* faces upward for the remaining free tosses. The gaming system updates the free tosses remaining meter 395 to indicate that two free tosses remain. The gaming system displays the following message in the message box 360: "SORRY, NO WINNING SYMBOL COMBINATIONS ARE DISPLAYED, BUT TWO MORE JACKPOT SYMBOLS ARE LOCKED!"

Figure 3I:
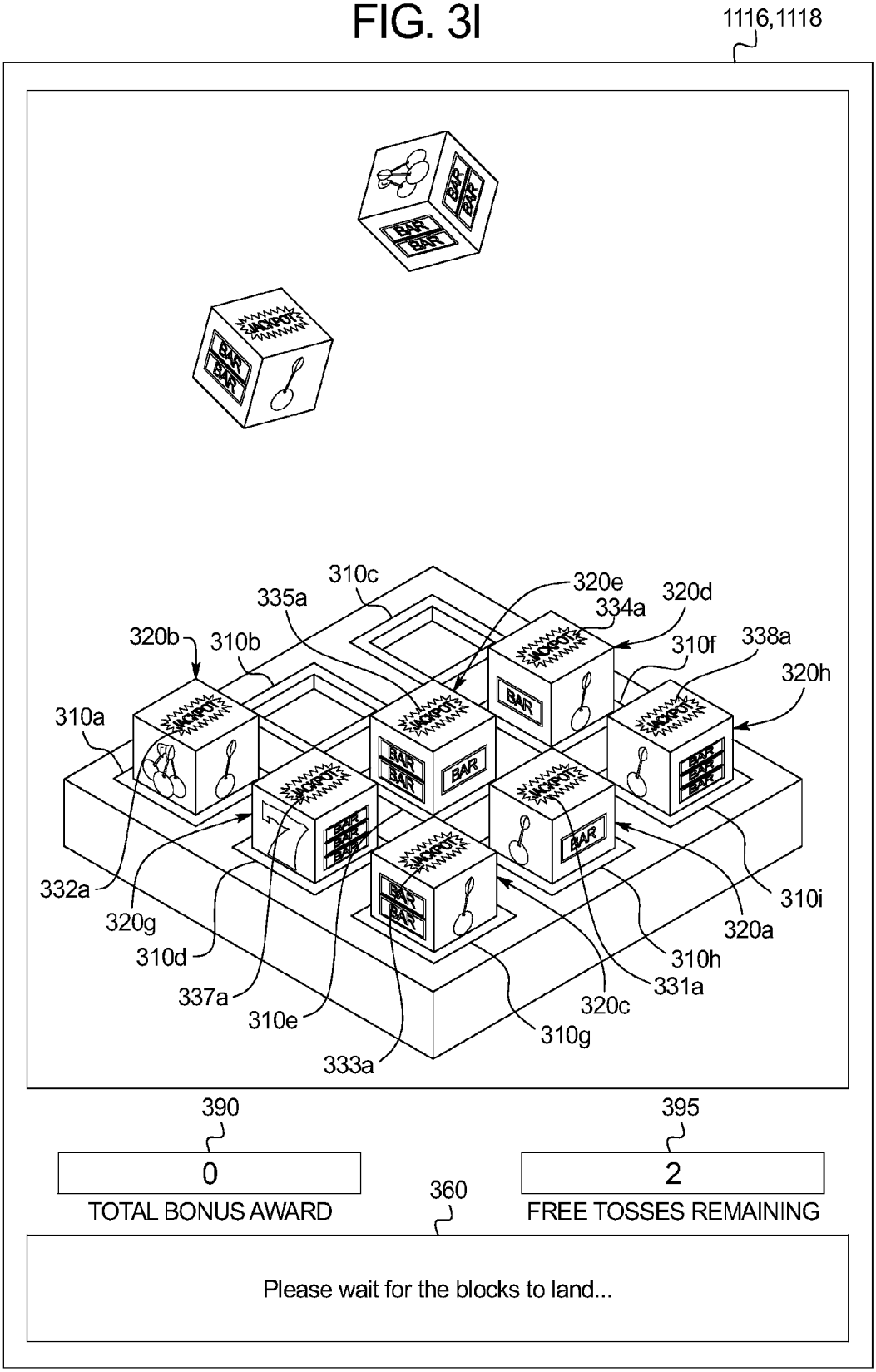

As illustrated in FIG. 3I, for the fourth free toss, the gaming system displays each of the non-locked bonus objects being tossed out of the object display areas and into the air to indicate that those bonus objects will be randomly associated with the object display areas. In other words, the gaming system displays those bonus objects being tossed into the air to indicate that those bonus objects (and, therefore the bonus symbol sets associated with those bonus objects) are, at this point in time, not permanently associated with any given object display area. The gaming system displays the following message in the message box 360: "PLEASE WAIT FOR THE BLOCKS TO LAND . . . "

For the fourth free toss, the gaming system randomly associates: (a) the bonus object 320*f* (and, therefore, the symbol set associated with the bonus object 320*f*) with the object display area 310*b*; and (b) the bonus object 320*i* (and, therefore, the bonus symbol set associated with the bonus object 320*i*) with the object display area 310*c*.

Additionally, for the fourth free toss, the gaming system randomly selects: (a) the Bar symbol 336*b* of the bonus object 320*f*, and (b) the Jackpot symbol 339*a* of the bonus object 320*i*.

Figure 3J:
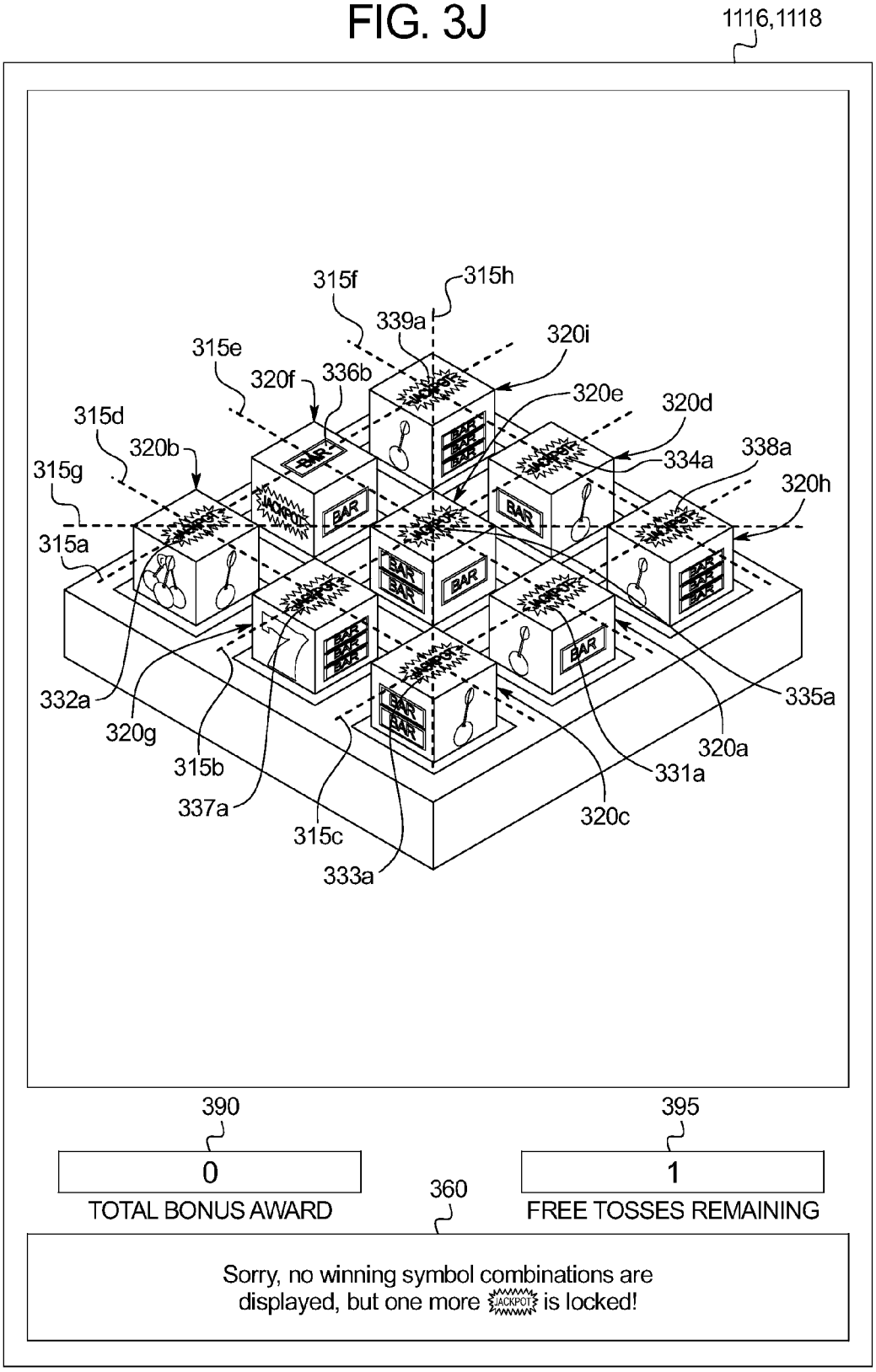

Accordingly, as shown in FIG. 3J, the gaming system displays: (a) the bonus object 320*b* at the object display area 310*a* such that the Jackpot symbol 332*a* faces upward, (b) the bonus object 320*f* at the object display area 310*b* such that the Bar symbol 336*b* faces upward, (c) the bonus object 320*i* at the object display area 310*c* such that the Jackpot symbol 339*a* faces upward, (d) the bonus object 320*g* at the object display area 310*d* such that the Jackpot symbol 337*a* faces upward, (e) the bonus object 320*e* at the object display area 310*e* such that the Jackpot symbol 335*a* faces upward, (f) the bonus object 320*d* at the object display area 310*f* such that the Jackpot symbol 334*a* faces upward, (g) the bonus object 320*c* at the object display area 310*g* such that the Jackpot symbol 333*a* faces upward, (h) the bonus object 320*a* at the object display area 310*h* such that the Jackpot symbol 331*a* faces upward, and (i) the bonus object 320*h* at the object display area 310*i* such that the Jackpot symbol 338*a* faces upward.

The gaming system makes an award determination based on the displayed upwardly-facing symbols and the paytable associated with the slot game for the bonus. More specifically, the gaming system determines whether any of the plurality of winning symbol combinations included in the paytable are displayed along any of the paylines 315*a*, 315*b*, 315*c*, 315*d*, 315*e*, 315*f*, 315*g*, and/or 315*h*. In this example embodiment, the gaming system determines that none of the winning symbol combinations are displayed along any of the paylines and, therefore, not to provide any awards for the fourth free toss.

As noted above, the Jackpot symbol is the locking symbol. Accordingly, following the third free toss, the gaming system: (a) continues to lock: (i) the bonus object 320*b* at the object display area 310*a* such that the Jackpot symbol 332*a* faces upward for the remaining free tosses, (ii) the bonus object 320*c* at the object display area 310*g* such that the Jackpot symbol 333*a* faces upward for the remaining free tosses, (iii) the bonus object 320*a* at the object display area 310*h* such that the Jackpot symbol 331*a* faces upward for the remaining free tosses; (iv) the bonus object 320*g* at the object display area 310*d* such that the Jackpot symbol 337*a* faces upward for the remaining free tosses, (v) the bonus object 320*e* at the object display area 310*e* such that the Jackpot symbol 335*a* faces upward for the remaining free tosses, (vi) the bonus object 320*d* at the object display area 310*f* such that the Jackpot symbol 334*a* faces upward for the remaining free tosses or throes, and (vii) the bonus object 320*h* at the object display area 310*i* such that the Jackpot symbol 338*a* faces upward for the remaining free tosses; and (b) locks the bonus object 320*i* at the object display area 310*c* such that the Jackpot symbol 339*a* faces upward for the remaining free tosses. The gaming system updates the free tosses remaining meter 395 to indicate that one free toss remains. The gaming system displays the following message in the message box 360: "SORRY, NO WINNING SYMBOL COMBINATIONS ARE DISPLAYED, BUT ONE MORE JACKPOT SYMBOL IS LOCKED!"

Figure 3K:
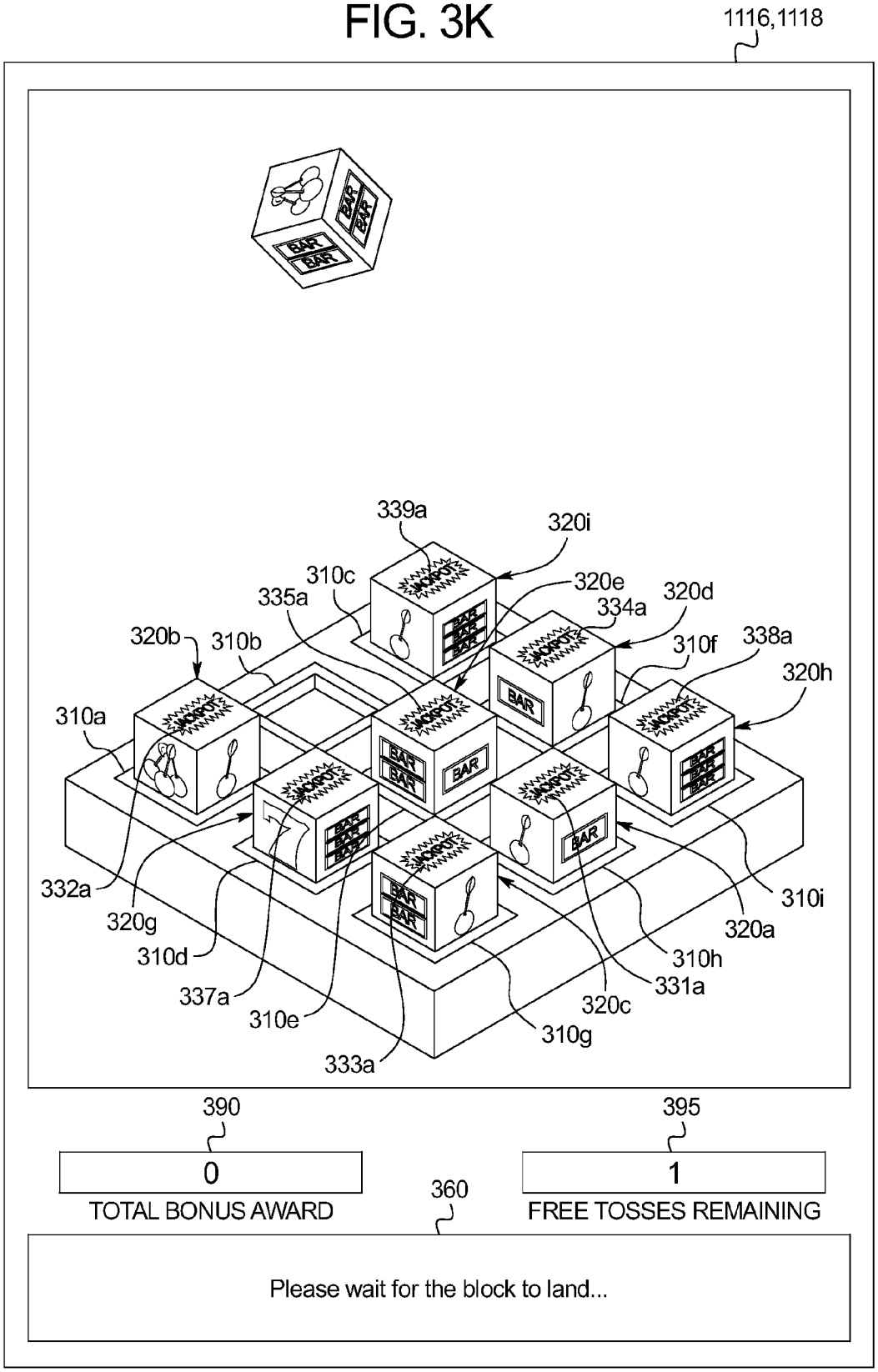

As illustrated in FIG. 3K, for the fifth free toss, since only one of the bonus objects is a non-locked bonus object, the gaming system displays non-locked bonus object 320*f* being tossed out of the object display area 310*b*. The gaming system displays the following message in the message box 360: "PLEASE WAIT FOR THE BLOCK TO LAND . . . "

Figure 3L:
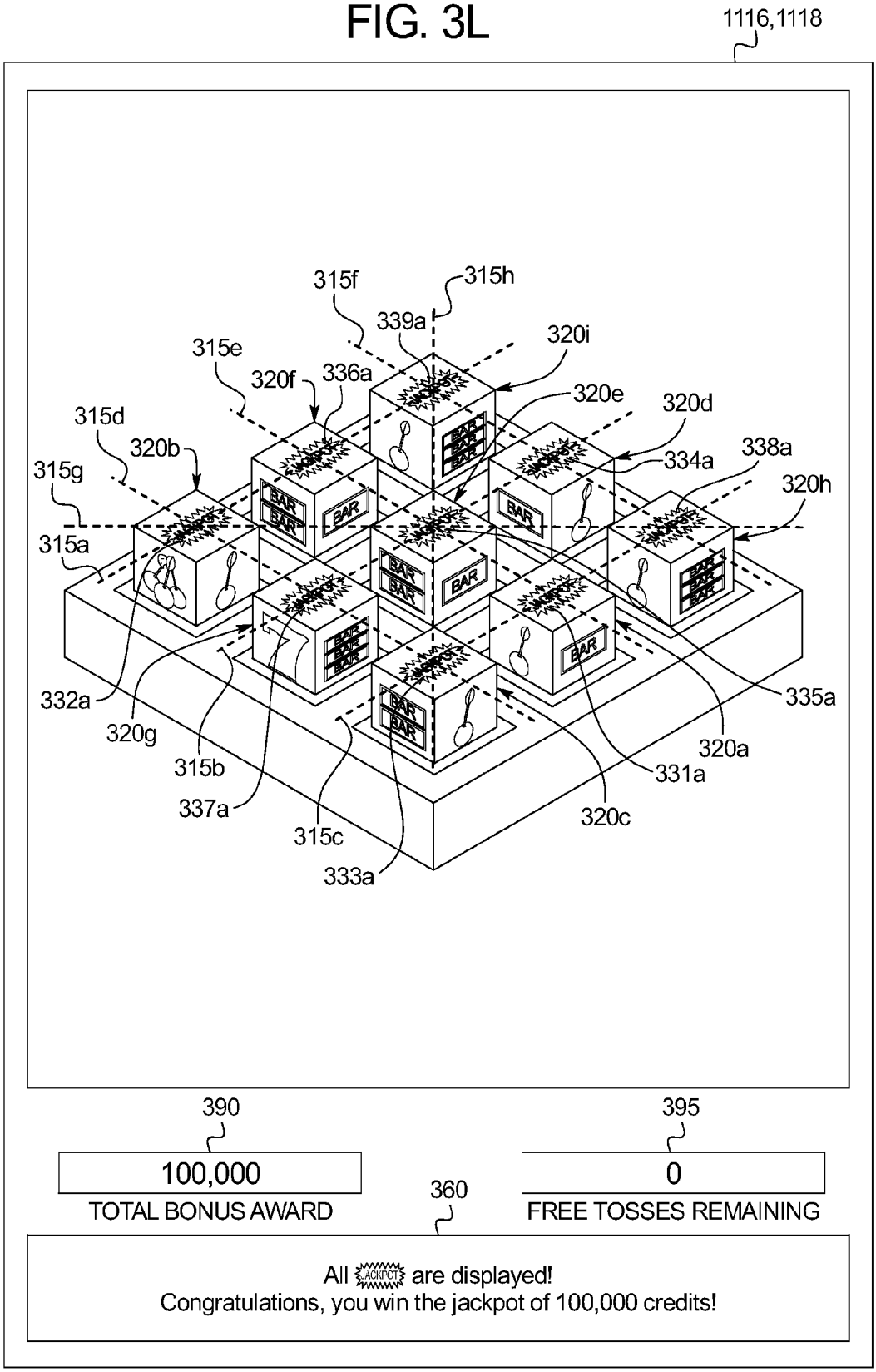

For the fifth free toss, the gaming system randomly selects the Jackpot symbol 336*a* of the bonus object 320*f*. Accordingly, as shown in FIG. 3L, the gaming system displays: (a) the bonus object 320*b* at the object display area 310*a* such that the Jackpot symbol 332*a* faces upward, (b) the bonus object 320*f* at the object display area 310*b* such that the Jackpot symbol 336*a* faces upward, (c) the bonus object 320*i* at the object display area 310*c* such that the Jackpot symbol 339*a* faces upward, (d) the bonus object 320*g* at the object display area 310*d* such that the Jackpot symbol 337*a* faces upward, (e) the bonus object 320*e* at the object display area 310*e* such that the Jackpot symbol 335*a* faces upward, (f) the bonus object 320*d* at the object display area 310*f* such that the Jackpot symbol 334*a* faces upward, (g) the bonus object 320*c* at the object display area 310*g* such that the Jackpot symbol 333*a* faces upward, (h) the bonus object 320*a* at the object display area 310*h* such that the Jackpot symbol 331*a* faces upward, and (i) the bonus object 320*h* at the object display area 310*i* such that the Jackpot symbol 338*a* faces upward.

The gaming system makes an award determination based on the displayed upwardly-facing symbols and the paytable associated with the slot game for the bonus. More specifically, the gaming system determines whether any of the plurality of winning symbol combinations included in the paytable are displayed along the paylines 315*a*, 315*b*, 315*c*, 315*d*, 315*e*, 315*f*, 315*g*, and/or 315*h*. The gaming system determines that none of the wining symbol combinations are displayed along any of the paylines. However, the gaming system determines to provide the player the jackpot award of 100,000 credits because each of the bonus objects displays the Jackpot symbol. The gaming system updates the free tosses remaining meter 395 to indicate that no free tosses remain. The gaming system displays the 100,000 credit award in the total bonus award meter 390 and displays the following message in the message box 360: "ALL JACKPOT SYMBOLS ARE DISPLAYED!CONGRATULATIONS, YOU WIN THE JACKPOT OF 100,000 CREDITS!" Since the gaming system has provided each of the free tosses, the gaming system ends the bonus and returns to primary game play.

In other embodiments, if the gaming system does not display any matching symbols facing upward following the first free toss, the gaming system does not determine a locking symbol and repeats the locking symbol determination following each subsequent free toss until the gaming system determines a locking symbol or until the gaming system has provided all of the free tosses. In further embodiments, if the gaming system does not display any matching symbols facing upward following the first free toss, the gaming system does not determine a locking symbol for the bonus. In certain embodiments, The gaming system designates the symbol having the most matches as the locking symbol for the duration of the bonus if at least a designated quantity of the matching symbols are displayed. In various embodiments, the gaming system may designate one of a plurality of designated symbols as the locking symbol, and may not designate any non-designated symbols as the locking symbol.

While the gaming system determines any awards via a directional payline-based award evaluation in the example embodiments described herein, it should be appreciated that the gaming system may employ any suitable type of award evaluation instead of (or in addition to) a directional payline-based award evaluation, such as (but not limited to) a scatter pay award evaluation, a ways-to-win award evaluation (described below), an adjacent pays award evaluation, and/or a different directional payline-based award evaluation.

In certain embodiments, the slot game includes a re-spin or re-toss feature that, when activated, causes the gaming system to re-toss one (or more) of the objects such that the gaming system performs another random determination of one of the symbols of the symbol set associated with the re-tossed object. In one example embodiment, after determining any awards associated with the displayed outcome, the gaming system: (a) enables the player to select one of the objects, (b) displays the selected object being tossed from its object display area into the air, (c) randomly selects one of the symbols of the symbol set associated with the selected object, (d) displays the selected object at the object display area such that the selected symbol faces upward, and (e) determines and displays any awards associated with the displayed upwardly-facing symbols. It should thus be appreciated that, in this example embodiment, the gaming system makes two separate award determinations, one associated with the initially-displayed outcome and another associated with the (potentially) modified outcome after the re-spin or re-toss feature is employed.

In another example embodiment, before determining any awards associated with the displayed outcome, the gaming system: (a) enables the player to select one of the objects, (b) displays the selected object being tossed from its object display area into the air, (c) randomly selects one of the symbols of the symbol set associated with the selected object, (d) displays the selected object at the object display area such that the selected symbol faces upward, and (e) determines and displays any awards associated with the displayed upwardly-facing symbols. It should thus be appreciated that, in this example embodiment, the gaming system enables the player to (potentially) modify the displayed outcome using the re-spin or re-toss feature before any awards are provided.

In the above-described example embodiments, the ratio of symbol sets to symbol display areas is 1-to-1. Put differently, in the above-described example embodiments, each symbol set is employed and associated with one of the symbol display areas for each play of the slot game. In other embodiments, however, the ratio of symbol sets to symbol display areas is X-to-1, where X is greater than 1. In other words, in these example embodiments, fewer than all of the symbol sets are employed and associated with the symbol display areas for each play of the slot game. For instance, in one such example embodiment, the slot game is associated with eighteen different symbol sets and nine symbol display areas. In this example embodiment, for a play of the slot game, the gaming system: (a) randomly selects nine of the eighteen symbol sets to employ for the play of the slot game; (b) randomly associates each of the selected symbol sets with a different one of nine symbol display areas; and (c) for each of the selected symbol sets, the gaming system randomly selects one of the symbols of that symbol set and displays the randomly selected symbol at the associated symbol display area. Thus, in this example embodiment, the unselected nine of the eighteen symbol sets are not employed for the play of the slot game. In various embodiments, the symbol sets are each represented by individual, independent reels. In these embodiments, for a play of the slot game, the gaming system: (a) randomly associates different independent reels with different symbol display areas; and (b) for each independent reel, randomly selects one of the symbols on that independent reel and displays the selected symbol at the associated symbol display area.

In certain embodiments, the gaming system evaluates the displayed symbols that are not facing upward, such as to determine whether to trigger the bonus.

It should be appreciated that, in various embodiments, for a play of the slot game, for each symbol set, the gaming system displays one of the symbols of that symbol set at the symbol display area with which that symbol set is associated and does not display any of the symbols of that symbol set at any of the symbol display areas with which that symbol set is not associated.

It should be appreciated that:

(a) the quantity of symbol sets;
(b) the quantity of symbols in a given symbol set;
(c) the particular symbols included in a given symbol set;
(d) the quantity of paylines;
(e) the symbol display areas with which a given payline is associated;
(f) the quantity of symbol display areas;
(g) the configuration of the symbol display areas (e.g., a 3×3 matrix, a 4×4 matrix, a 5×5 matrix, a 3×5 matrix, etc.);
(h) in embodiments in which the ratio of symbol sets to symbol display areas is greater than 1-to-1, the determination of which symbol sets to employ for a play of the slot game;
(i) the determination of which symbol sets to associate with which symbol display areas;
(j) the determination of which symbol to select from each employed symbol set;
(k) the bonus triggering event;
(l) the paytable (including the particular winning symbol combination(s) and associated awards);

(m) player eligibility for the bonus;

(n) the type of object used to represent a symbol set;

(o) the ratio of symbol sets to symbol display areas;

(p) the type of game or games provided in the bonus;

(q) the designated quantity of free tosses;

(r) the determination of the locking symbol;

(s) the determination of whether to activate the re-spin or re-toss feature; and/or (t) any other variables or determinations described herein may be: (1) predetermined; (2) randomly determined; (3) randomly determined based on one or more weighted percentages (such as according to a weighted table); (4) determined based on a generated symbol or symbol combination; (5) determined independent of a generated symbol or symbol combination; (6) determined based on a random determination by a central controller (described below); (7) determined independent of a random determination by the central controller; (8) determined based on a random determination at an electronic gaming machine (EGM) configured to operate the slot game (described below); (9) determined independent of a random determination at the EGM; (10) determined based on at least one play of at least one game; (11) determined independent of at least one play of at least one game; (12) determined based on a player's selection; (13) determined independent of a player's selection; (14) determined based on one or more side wagers placed; (15) determined independent of one or more side wagers placed; (16) determined based on the player's primary game wager or wager level; (17) determined independent of the player's primary game wager or wager level; (18) determined based on time (such as the time of day); (19) determined independent of time (such as the time of day); (20) determined based on an amount of coin-in accumulated in one or more pools; (21) determined independent of an amount of coin-in accumulated in one or more pools; (22) determined based on a status of the player (i.e., a player tracking status); (23) determined independent of a status of the player (i.e., a player tracking status); (24) determined based on one or more other determinations disclosed herein; (25) determined independent of any other determination disclosed herein; and/or (26) determined in any other suitable manner or based on or independent of any other suitable factor(s).

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 4A:
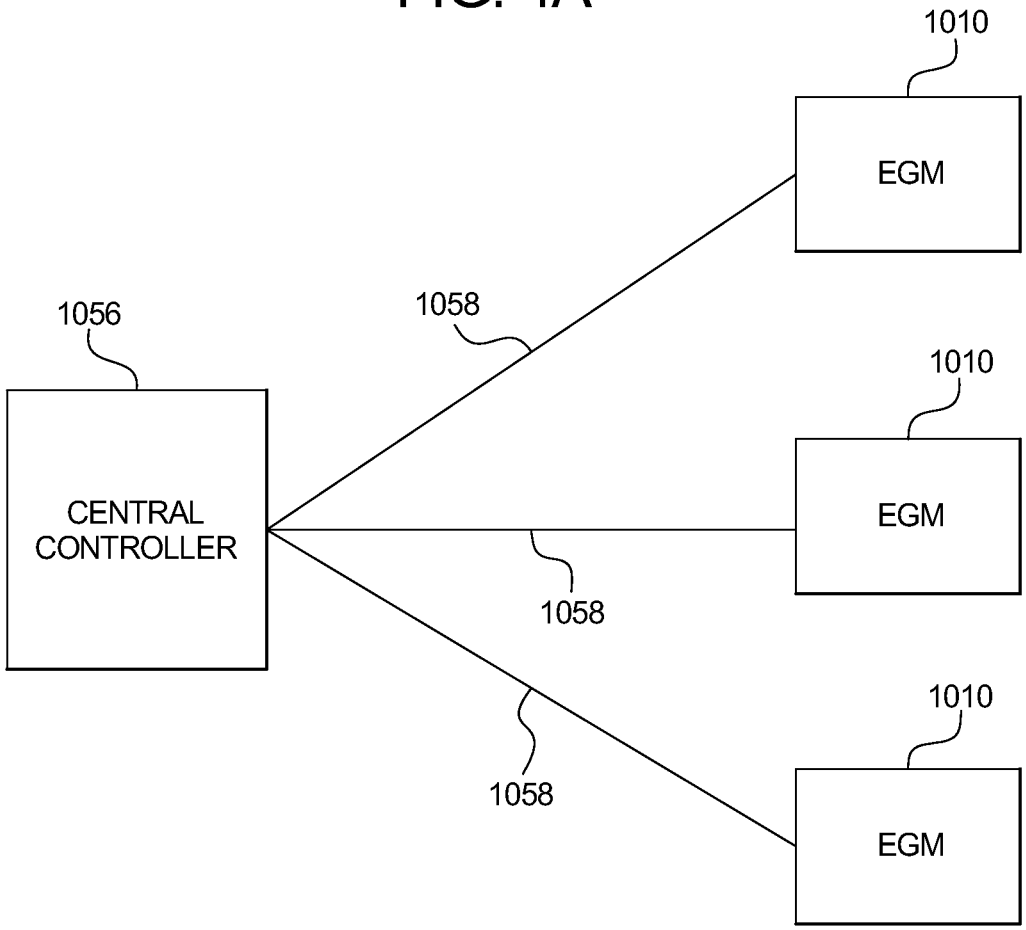
FIG. 4A is a schematic block diagram of one embodiment of a network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 4A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 4B:
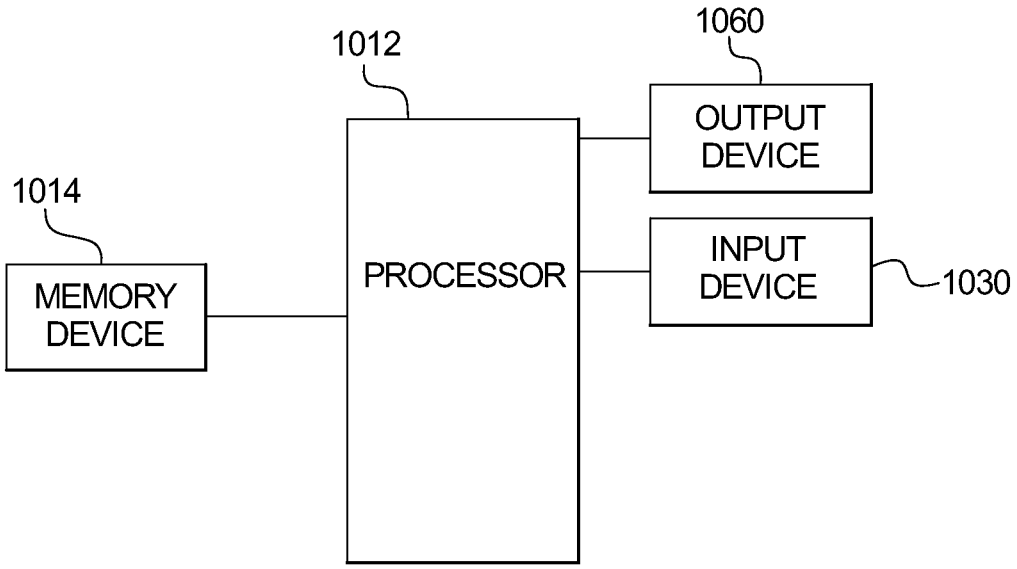
FIG. 4B is a schematic block diagram of an example electronic configuration of the gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 4B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferroelectric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 4B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 5A:
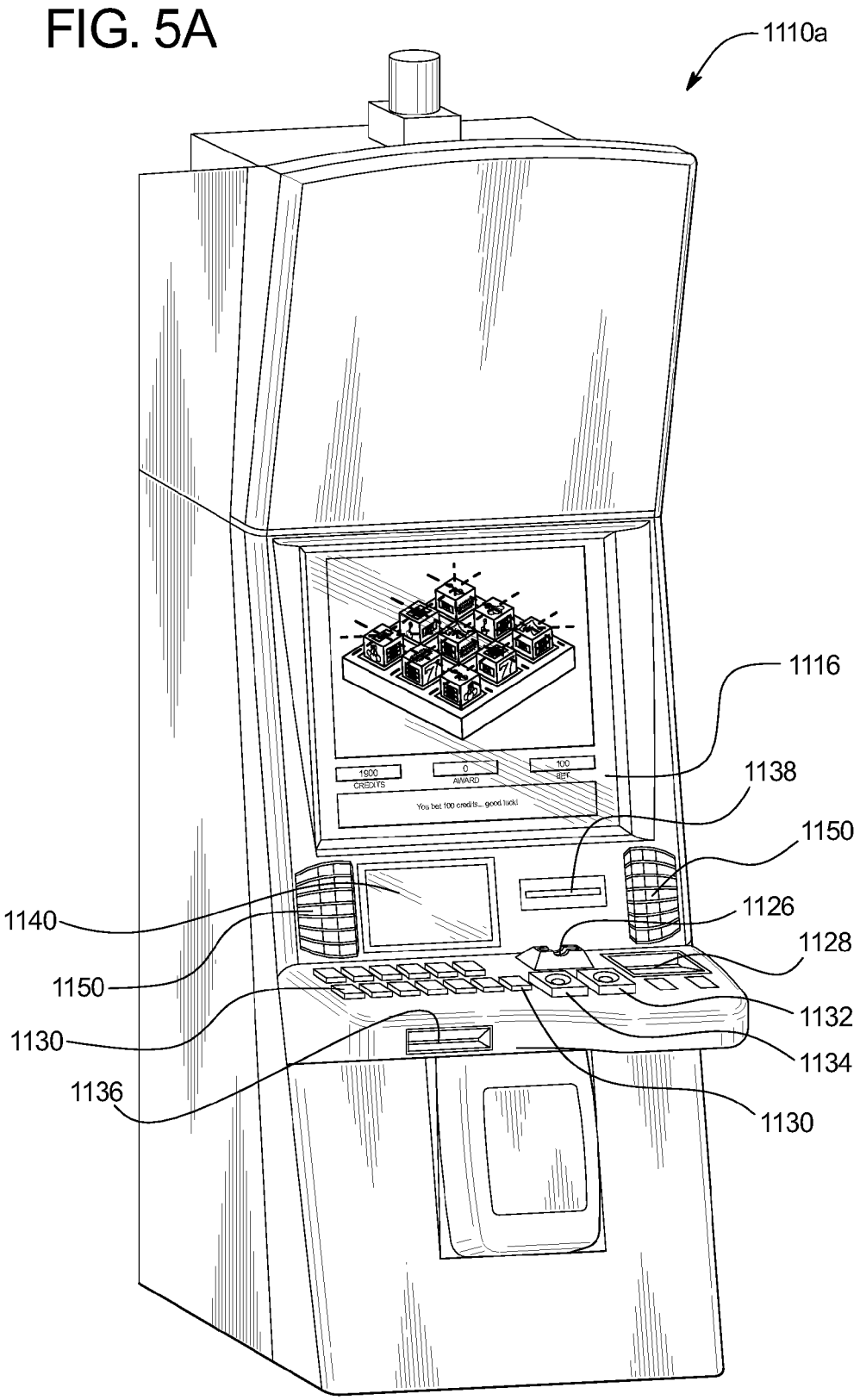
FIGS. 5A and 5B are perspective views of example alternative embodiments of the gaming system of the present disclosure.
Figure 5B:
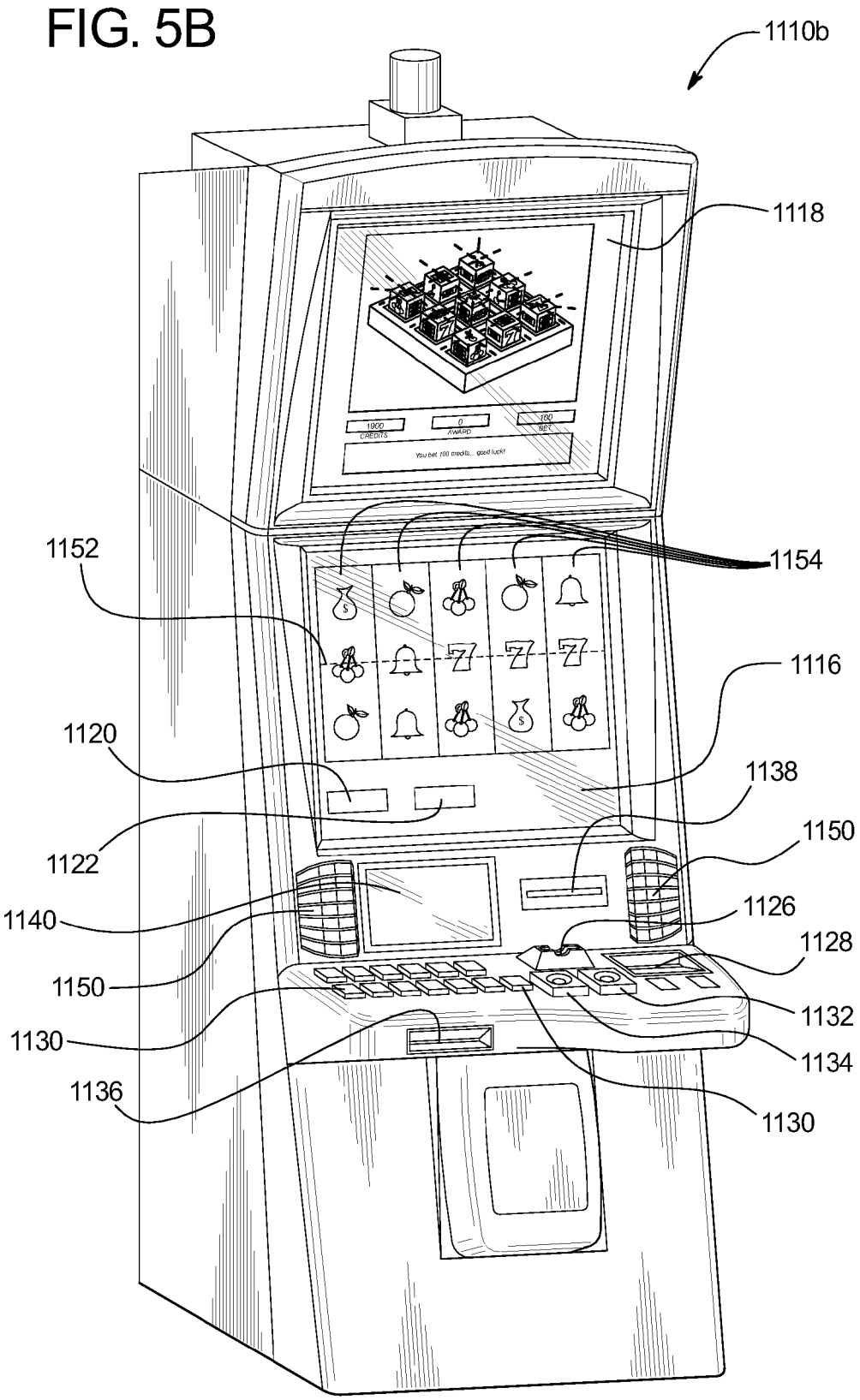

In various embodiments, the EGM includes one or more input devices. The input devices may include any suitable device that enables an input signal to be produced and received by the at least one processor of the EGM. The example EGM illustrated in FIG. 4B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 5A and 5B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 5A and 5B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 5A and 5B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 5A and 5B each include a card reader 1138. The card reader is configured to read a player identification card inserted into the card reader.

In various embodiments, the EGM includes one or more output devices. The example EGM illustrated in FIG. 4B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 5A includes a central display device 1116, a player tracking display 1140, a credit display 1120, and a bet display 1122. The example EGM illustrated in FIG. 5B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 5A and 5B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 5A and 5B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 5A and 5B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 5A and 5B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGM shown in FIG. 5B includes a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

a housing;

a plurality of input devices supported by the housing, the plurality of input devices including an acceptor and a validator;

at least one display device supported by the housing;

at least one processor; and at least one memory device that stores a plurality of instructions which, when executed by the at least one processor, cause the at least one processor to operate with the plurality of input devices and the at least one display device to:

(a) if a physical item associated with a monetary value is received by the acceptor, identify by the validator the received physical item and establish a credit balance based at least in part on the monetary value associated with the received and identified physical item;

(b) if a wager input is received via actuation of a wager button, place a wager on a play of a game, said wager being deductible from the credit balance;

(c) if a triggering event occurs in association with said play of the game:

(1) for each of a plurality of symbol display areas:

(i) randomly associate one of a plurality of different symbol sets with said symbol display area, wherein each of the symbol sets includes two or more symbols;

(ii) randomly determine one of the symbols of said symbol set associated with said symbol display area; and (iii) display said randomly determined symbol of said symbol set associated with said symbol display area at said symbol display area;

(2) determine any awards associated with the displayed symbols; and (3) display any determined awards, the credit balance being increasable by any determined awards;

(4) designate one of the displayed symbols as a locking symbol; and (5) continue displaying each displayed instance of the locking symbol at the symbol display area at which said instance of the locking symbol is displayed, repeat (c)(1)(i) to (c)(1)(iii) for each symbol display area at which an instance of the locking symbol is not displayed, and repeat (c)(2) to (c)(3); and (d) if a cashout input is received via actuation of a cashout button, initiate a payout associated with the credit balance.

2. The gaming system of claim 1, wherein the plurality of instructions, when executed by the at least one processor, cause the at least one processor to operate with the at least one display device to, for each of the symbol display areas, display an object representing the symbol set associated with said symbol display area in association with said symbol display area.

3. The gaming system of claim 2, wherein, for each of the symbol sets, the object representing said symbol set includes each of the symbols of said symbol set.

4. The gaming system of claim 1, wherein the plurality of instructions, when executed by the at least one processor, cause the at least one processor to randomly associate a different one of the symbol sets with each of the symbol display areas.

5. The gaming system of claim 1, wherein a quantity of the symbol sets is greater than a quantity of the symbol display areas.

6. A method of operating a gaming system, said method comprising:

(a) if a physical item associated with a monetary value is received by an acceptor, identifying by a validator the received physical item and causing at least one processor to execute a plurality of instructions stored in at least one memory device to establish a credit balance based at least in part on the monetary value associated with the received and identified physical item;

(b) if a wager input is received via actuation of a wager button, causing the at least one processor to execute the plurality of instructions to place a wager on a play of a game, said wager being deductible from the credit balance;

(c) if a triggering event occurs in association with said play of the game:

(1) for each of a plurality of symbol display areas, causing the at least one processor to execute the plurality of instructions to:

(i) randomly associate one of a plurality of different symbol sets with said symbol display area, wherein each of the symbol sets includes two or more symbols;

(ii) randomly determine one of the symbols of said symbol set associated with said symbol display area; and (iii) operate with the at least one display device to display said randomly determined symbol of said symbol set associated with said symbol display area at said symbol display area;

(2) causing the at least one processor to execute the plurality of instructions to determine any awards associated with the displayed symbols;

(3) causing the at least one processor to execute the plurality of instructions to operate with the at least one display device to display any determined awards, the credit balance being increasable by any determined awards;

(4) causing the at least one processor to execute the plurality of instructions to designate one of the displayed symbols as a locking symbol; and (5) causing the at least one processor to execute the plurality of instructions to operate with the at least one display device to continue displaying each displayed instance of the locking symbol at the symbol display area at which said instance of the locking symbol is displayed, repeating (c)(1)(i) to (c)(1)(iii) for each symbol display area at which an instance of the locking symbol is not displayed, and repeating (c)(2) to (c)(3); and (d) if a cashout input is received via actuation of a cashout button, causing the at least one processor to execute the plurality of instructions to initiate a payout associated with the credit balance.

7. The method of claim 6, which includes causing the at least one processor to execute the plurality of instructions to operate with the at least one display device to, for each of the symbol display areas, display an object representing the symbol set associated with said symbol display area in association with said symbol display area.

8. The method of claim 7, wherein, for each of the symbol sets, the object representing said symbol set includes each of the symbols of said symbol set.

9. The method of claim 6, which includes causing the at least one processor to execute the plurality of instructions to randomly associate a different one of the symbol sets with each of the symbol display areas.

10. The method of claim 6, wherein a quantity of the symbol sets is greater than a quantity of the symbol display areas.

11. The method of claim 6, which is provided through a data network.

12. The method of claim 11, wherein the data network is an internet.

13. A non-transitory computer readable medium storing a plurality of instructions which, when executed by at least one processor, cause the at least one processor to:

(a) following receipt by an acceptor of a physical item associated with a monetary value and identification by a validator of the received physical item, establish a credit balance based at least in part on the monetary value associated with the received and identified physical item;

(b) if a wager input is received via actuation of a wager button, place a wager on a play of a game, said wager being deductible from the credit balance;

(c) if a triggering event occurs in association with said play of the game;

(1) for each of a plurality of the symbol display areas:

(i) randomly associate one of a plurality of different symbol sets with said symbol display area, wherein each of the symbol sets includes two or more symbols;

(ii) randomly determine one of the symbols of said symbol set associated with said symbol display area; and (iii) cause the at least one display device to display said randomly determined symbol of said symbol set associated with said symbol display area at said symbol display area;

(2) determine any awards associated with the displayed symbols; and (3) cause the at least one display device to display any determined awards, the credit balance being increasable by any determined awards;

(4) designate one of the displayed symbols as a locking symbol; and (5) cause the at least one display device to continue displaying each displayed instance of the locking symbol at the symbol display area at which said instance of the locking symbol is displayed, repeat (c)(1)(i) to (c)(1)(iii) for each symbol display area at which an instance of the locking symbol is not displayed, and repeat (c)(2) to (c)(3); and (d) if a cashout input is received via actuation of a cashout button, initiate a payout associated with the credit balance.

14. The non-transitory computer readable medium of claim 13, wherein the plurality of instructions, when executed by the at least one processor, cause the at least one processor to cause the at least one display device to, for each of the symbol display areas, display an object representing the symbol set associated with said symbol display area in association with said symbol display area.

15. The non-transitory computer readable medium of claim 13, wherein, for each of the symbol sets, the object representing said symbol set includes each of the symbols of said symbol set.

16. The non-transitory computer readable medium of claim 13, wherein the plurality of instructions, when executed by the at least one processor, cause the at least one processor to randomly associate a different one of the symbol sets with each of the symbol display areas.

17. The non-transitory computer readable medium of claim 13, wherein a quantity of the symbol sets is greater than a quantity of the symbol display areas.

18. The gaming system of claim 1, wherein the plurality of instructions, when executed by the at least one processor, cause the at least one processor to designate the displayed symbol having a highest value as the locking symbol.

19. The method of claim 6, which includes causing the at least one processor to execute the plurality of instructions to designate the displayed symbol having a highest value as the locking symbol.

20. The non-transitory computer readable medium of claim 13, wherein the plurality of instructions, when executed by the at least one processor, cause the at least one processor to designate the displayed symbol having a highest value as the locking symbol.

* * * * *